US008783419B2

(12) United States Patent
Zuercher

(10) Patent No.: US 8,783,419 B2
(45) Date of Patent: Jul. 22, 2014

(54) LOW PROFILE WHEELCHAIR LIFT WITH DIRECT-ACTING HYDRAULIC CYLINDERS

(75) Inventor: Eric Zuercher, Tucson, AZ (US)

(73) Assignee: AGM Container Controls, Inc., Tucson, AZ (US)

( * ) Notice: Subject to any disclaimer, the term of this patent is extended or adjusted under 35 U.S.C. 154(b) by 328 days.

(21) Appl. No.: 13/288,927

(22) Filed: Nov. 3, 2011

(65) Prior Publication Data

US 2013/0112504 A1 May 9, 2013

(51) Int. Cl.
*B66B 9/08* (2006.01)
*B66B 9/16* (2006.01)

(52) U.S. Cl.
CPC ..... *B66B 9/0807* (2013.01); *B66B 9/0853* (2013.01); *B66B 9/16* (2013.01); *Y10S 414/134* (2013.01)
USPC ..... 187/200; 187/242; 414/921

(58) Field of Classification Search
CPC ..... B66B 9/04; Y10S 414/134; A61G 3/06; A61G 3/063
USPC ..... 187/200, 242, 243, 274; 414/540, 921
See application file for complete search history.

(56) References Cited

U.S. PATENT DOCUMENTS 1,751,644 A * 3/1930 McKenzie ..... 187/357
2,514,314 A 7/1950 Denton
2,724,520 A 11/1955 Overbeck
2,867,111 A * 1/1959 Youtz ..... 52/125.1
3,172,501 A 3/1965 Ramer
3,338,334 A * 8/1967 Matthews ..... 187/213
3,341,760 A 9/1967 Fry
3,401,514 A * 9/1968 Clark ..... 56/328.1
3,516,513 A * 6/1970 Jackson et al. ..... 182/19
3,522,925 A 8/1970 Buchtel et al.
3,524,563 A 8/1970 McCartney et al.
3,526,066 A 9/1970 Gamble et al.
3,613,834 A * 10/1971 Field ..... 187/274

(Continued)

FOREIGN PATENT DOCUMENTS

DE 3325036 A1 1/1985
DE 102005042630 A1 3/2007

(Continued)

OTHER PUBLICATIONS

"Ascension Portable Wheelchair Lift" brochure, published by AGM Container Controls, Inc., and describing Models SLA-2050ED and SLA-2050ESD, both offered for sale in the United States prior to Dec. 2003.

(Continued)

*Primary Examiner* — Michael Mansen
*Assistant Examiner* — Minh Truong
(74) *Attorney, Agent, or Firm* — Cahill Glazer PLC

(57) ABSTRACT

A wheel chair lift device includes a pair of upside-down, vertically-oriented hydraulic cylinders having their closed ends attached to opposing sides of a lift car, and their piston rods secured to a base resting on the floor. The cylinders extend into the hollow internal channels of two fixed vertical guide members as the lift car is lowered. The vertical guide members may be received within the side walls of the lift car as the lift is lowered to the ground. Rollers on the lift car engage the vertical exterior walls of the vertical guide members to stabilize the lift car. No moving parts are exposed apart from the lift car itself.

14 Claims, 21 Drawing Sheets

(56) References Cited

U.S. PATENT DOCUMENTS

| | | | | | |
|---|---|---|---|---|---|
| 3,633,466 | A | * | 1/1972 | Field | 92/85 R |
| 3,661,228 | A | | 5/1972 | Glasser | |
| 3,749,201 | A | * | 7/1973 | Clarke | 187/243 |
| 3,757,899 | A | * | 9/1973 | Smith, Jr. | 187/224 |
| 3,759,409 | A | * | 9/1973 | Wenzel et al. | 414/460 |
| 3,785,462 | A | | 1/1974 | Coad et al. | |
| 3,806,092 | A | | 4/1974 | Richards | |
| 3,829,115 | A | | 8/1974 | Rich | |
| 3,879,050 | A | | 4/1975 | Young | |
| 3,880,259 | A | | 4/1975 | Richards | |
| 3,885,685 | A | * | 5/1975 | Montgomery et al. | 414/391 |
| 3,888,463 | A | | 6/1975 | O'Brien et al. | |
| 3,902,573 | A | | 9/1975 | Grove et al. | |
| 3,918,596 | A | * | 11/1975 | Ward | 414/545 |
| 3,982,718 | A | | 9/1976 | Folkenroth et al. | |
| 4,056,203 | A | | 11/1977 | Meldahl et al. | |
| 4,063,619 | A | | 12/1977 | Drews | |
| 4,081,091 | A | * | 3/1978 | Thorley | 414/545 |
| 4,124,097 | A | * | 11/1978 | Hawks et al. | 414/540 |
| 4,124,100 | A | * | 11/1978 | Hawks | 414/540 |
| 4,173,268 | A | | 11/1979 | Nussbaum | |
| 4,176,732 | A | | 12/1979 | Nordskog | |
| 4,219,103 | A | | 8/1980 | Harsacky | |
| 4,219,104 | A | * | 8/1980 | MacLeod | 414/540 |
| 4,285,416 | A | * | 8/1981 | Dudynskyj | 414/540 |
| 4,392,771 | A | | 7/1983 | Smalley | |
| 4,436,183 | A | * | 3/1984 | Laurich-Trost | 187/224 |
| 4,457,402 | A | | 7/1984 | Del Vecchio et al. | |
| 4,466,771 | A | | 8/1984 | Thorley et al. | |
| 4,479,753 | A | | 10/1984 | Thorley | |
| 4,488,326 | A | | 12/1984 | Cherry | |
| 4,499,970 | A | | 2/1985 | Hussey | |
| 4,556,128 | A | | 12/1985 | Thorley et al. | |
| 4,576,539 | A | | 3/1986 | Williams | |
| 4,606,082 | A | * | 8/1986 | Kuhlman | 4/561.1 |
| 4,785,915 | A | | 11/1988 | Shah et al. | |
| 4,787,111 | A | | 11/1988 | Pacek et al. | |
| 4,848,519 | A | * | 7/1989 | Ericson et al. | 187/272 |
| 4,919,234 | A | * | 4/1990 | Pearson et al. | 187/213 |
| 4,926,973 | A | | 5/1990 | Smith | |
| 4,941,797 | A | | 7/1990 | Smillie, III | |
| 4,971,178 | A | | 11/1990 | Schauder et al. | |
| RE33,595 | E | | 5/1991 | Sullivan et al. | |
| 5,040,638 | A | | 8/1991 | Smith | |
| 5,040,936 | A | | 8/1991 | Rhea | |
| 5,046,585 | A | | 9/1991 | Ohta et al. | |
| 5,052,879 | A | | 10/1991 | Wolfe | |
| 5,105,915 | A | | 4/1992 | Gary | |
| 5,149,246 | A | | 9/1992 | Dorn | |
| 5,154,569 | A | | 10/1992 | Eryou et al. | |
| 5,205,697 | A | | 4/1993 | Getty et al. | |
| 5,275,526 | A | | 1/1994 | Moseley | |
| 5,281,017 | A | | 1/1994 | Geiss, II | |
| 5,299,658 | A | * | 4/1994 | Cox et al. | 187/209 |
| 5,322,408 | A | | 6/1994 | Wooden | |
| 5,346,355 | A | | 9/1994 | Riemer | |
| 5,382,130 | A | | 1/1995 | Kempf | |
| 5,426,817 | A | | 6/1995 | Rekuc | |
| 5,433,581 | A | | 7/1995 | Farsai | |
| 5,476,155 | A | | 12/1995 | Nakatani et al. | |
| 5,499,694 | A | | 3/1996 | Dorn | |
| 5,513,943 | A | | 5/1996 | Lugash et al. | |
| 5,553,990 | A | | 9/1996 | Kytola, Sr. | |
| 5,595,470 | A | | 1/1997 | Berkey et al. | |
| 5,597,282 | A | | 1/1997 | Hoffman et al. | |
| 5,597,987 | A | * | 1/1997 | Gilliland et al. | 187/285 |
| 5,674,043 | A | | 10/1997 | Dorn | |
| 5,822,829 | A | | 10/1998 | Webb et al. | |
| 5,836,020 | A | * | 11/1998 | Morris | 4/496 |
| 5,887,680 | A | | 3/1999 | Carson et al. | |
| 5,908,088 | A | * | 6/1999 | Webster et al. | 187/274 |
| 5,941,347 | A | | 8/1999 | Pfleger et al. | |
| 5,947,231 | A | | 9/1999 | Raab et al. | |
| 5,954,160 | A | | 9/1999 | Wells, Sr. et al. | |
| 5,992,571 | A | | 11/1999 | Lee | |
| 6,039,528 | A | | 3/2000 | Cohn | |
| 6,062,809 | A | | 5/2000 | Berkey et al. | |
| 6,086,314 | A | | 7/2000 | Savaria | |
| 6,095,747 | A | | 8/2000 | Cohn | |
| 6,105,934 | A | * | 8/2000 | Rober | 254/2 R |
| 6,109,395 | A | | 8/2000 | Storm | |
| 6,119,815 | A | | 9/2000 | Ziegler | |
| 6,155,770 | A | * | 12/2000 | Warhurst | 414/498 |
| 6,182,798 | B1 | | 2/2001 | Brady et al. | |
| 6,203,266 | B1 | | 3/2001 | Savaria et al. | |
| 6,345,694 | B1 | | 2/2002 | Volker | |
| 6,419,050 | B1 | | 7/2002 | Sardonico | |
| 6,435,804 | B1 | | 8/2002 | Hutchins | |
| 6,467,785 | B2 | | 10/2002 | Toppses | |
| 6,516,478 | B2 | | 2/2003 | Cook et al. | |
| 6,585,474 | B1 | | 7/2003 | Kameda | |
| 6,601,677 | B1 | | 8/2003 | Storm | |
| 6,814,342 | B1 | | 11/2004 | Perlstein et al. | |
| 6,837,670 | B2 | | 1/2005 | Goodrich | |
| 7,284,944 | B1 | | 10/2007 | Schlangen | |
| 7,721,850 | B2 | | 5/2010 | Coble | |
| 7,926,618 | B2 | | 4/2011 | Zuercher et al. | |
| 2003/0213653 | A1 | | 11/2003 | Morris | |
| 2004/0013504 | A1 | * | 1/2004 | Schults | 414/459 |
| 2006/0182570 | A1 | | 8/2006 | Zuercher et al. | |
| 2006/0182581 | A1 | | 8/2006 | Murray et al. | |
| 2008/0078624 | A1 | * | 4/2008 | Webster | 187/274 |
| 2008/0308357 | A1 | * | 12/2008 | Coble | 187/200 |

FOREIGN PATENT DOCUMENTS

| | | |
|---|---|---|
| GB | 1502921 | 3/1978 |
| JP | 9-173390 | 7/1997 |
| JP | 2004-182352 | 7/2004 |
| WO | 2006072013 A2 | 7/2006 |

OTHER PUBLICATIONS

"What Makes a Mohawk a Mohawk", All Automotive Equipment, Inc., Mohawk Lifts, published prior to May 2009, 13 pages.

* cited by examiner

LOW PROFILE WHEELCHAIR LIFT WITH DIRECT-ACTING HYDRAULIC CYLINDERS

CROSS-REFERENCE TO RELATED APPLICATIONS

The present application is related to a co-pending application Ser. No. 13/288,936, filed concurrently herewith, and entitled "Wheelchair Lift Device with Pinned Floor Struts", assigned to the assignee of the present application.

The present application is related to a co-ending application Ser. No. 13/288,940, filed concurrently herewith, and entitled "Height Adjustment System For Wheelchair Lift", assigned to the assignee of the present application.

BACKGROUND OF THE INVENTION

1. Field of the Invention

The present invention relates generally to lifting devices, and more particularly, to a wheelchair lift device to provide access to stages, platforms, risers and other elevated structures for individuals with disabilities.

2. Description of the Background Art

Under the Americans With Disabilities Act of 1990 (the "ADA"), the U.S. government required that public buildings be accessible to the disabled. For persons requiring a wheelchair for mobility, abrupt changes in floor elevation have to be modified to enable access by wheelchair. The ADA permits vertical lifting devices to be used instead of a ramp.

Lifting devices for the disabled are known in the prior art. For example, U.S. Pat. No. 5,105,915 (Gary) describes a lifting device having a car including fixed sides and short, one-piece ramps at each end. The car is raised and lowered by a pantograph jack including a hydraulic pump driven by an electric motor controlled by switches. The patent also describes several lifting devices of the prior art. Another wheelchair lifting device is disclosed in U.S. Pat. No. 6,182,798 to Brady, et al., and assigned to AGM Container Controls, Inc., the assignee of the present invention. The '798 patent discloses a lift device with gates at both ends of the lift car, transparent walls, a loading ramp, a dock plate, a stage height sensor, and numerous safety features. In addition, U.S. Pat. No. 7,926,618, also assigned to the assignee of the present invention, discloses a lift device suitable for elevating wheel chair-bound individuals to stages or platforms.

In many cases, wheel chair lifting devices can obstruct the view of persons in an audience at an event, particularly when the lift device is in its fully-elevated position. While it is important for those who are disabled to be able to have full access to stages and platforms within auditoriums, the lifting devices used to serve those who are handicapped should not become a viewing obstacle to others in attendance. Some lift devices employ relatively high towers, often in conjunction with idler gears and drive chains, to elevate a wheel chair lift car, and such towers tend to obstruct the surrounding view even when the lift car is fully lowered. Other lift devices are known which avoid the need for towers, but the lifting mechanism includes moving parts that need to be shielded to avoid injury to persons nearby, and to avoid interference with foreign objects that might find their way below the lift car. As an example, in assignee's U.S. Pat. No. 7,926,618, no towers are required, but pivoting hydraulic cylinders positioned on opposing sides of the lift car, and the hydraulic hoses attached thereto, must all be shielded from body parts and/or foreign objects, as by a pleated "skirt", which extends upwardly from the floor to the base of the lift car as the lift is elevated. Within U.S. Patent Application Publication No. 2008/0308358, also assigned to assignee, such a protective skirt is disclosed, along with sensors for detecting that a person, or object, has fallen against such protective skirt.

Moreover, while the lift device disclosed in assignee's U.S. Pat. No. 7,926,618 maintains a relatively low profile, elevation of the lift car requires movable intermediate members that are slidingly engaged with a lower fixed vertical track; the lift car is, in turn, slidingly engaged with such intermediate members. It would be preferred to avoid the need for such intermediate members to minimize expense and parts counts, while allowing the lift platform to be directly raised from a base. In addition, past efforts to provide a lift device having a low profile have included orientation of the hydraulic cylinders at an angle to the vertical; however, when lifting cylinders are oriented at an angle to the vertical, the force vector exerted in the upward direction is reduced, thereby requiring heavier, more-costly hydraulic cylinders, pumps, and motors, to provide the necessary lifting force. No matter what lifting system is utilized, it is obviously important to keep the lift car stable at all times, particularly when the lift car is elevated, to avoid injury to occupants.

Lift devices are known wherein the lifting forces are applied directly below the platform of the lift car that supports the occupant of the wheel chair. One advantage of lift devices is that the load borne by the platform of the lift car is directly supported by the lift mechanism. On the other hand, locating the lift mechanism directly below the lift platform presents a disadvantage. The lift mechanism always presents some thickness or depth, even when the lift is lowered, and by locating the lift mechanism directly below the lift platform, it is then virtually impossible to fully-lower the floor of the lift car flush with the floor. Accordingly, a loading ramp must then be provided to raise the wheel chair occupant from the ground up a few inches to the lift car floor when boarding the lift device. The loading ramp adds weight, cost, and complexity to the lift device.

One alternate technique which has been used in the past to avoid the need for a loading ramp is to house the lifting mechanism on the sides of the lift platform, rather than below the lift platform itself. However, applicant has discovered that, in certain circumstances, this alternate technique presents its own set of problems. When the lifting forces needed to elevate the lift car are applied to the sides of the lift car, the load borne by the floor of the lift car is transferred to the sides of the lift car. Under sufficient load, the floor of the lift car tends to bow downwardly. This bowing of the lift car floor exerts a torque upon the attached side walls of the lift car. As a result, the upper portions of the side walls of the lift car, which originally extended essentially vertically above the lower portions thereof when the lift car was lowered to the ground, now tilt inwardly toward each other. Angular deformation of the side walls of the lift car is problematic; for example, inward pressure exerted by the side walls upon the front entry gate (used when the lift is lowered) and the rear exit gate (used to exit the lift when raised to stage height) can "pinch" those gates, making them more difficult to open.

Wheel chair lift devices are often used repeatedly in conjunction with the same stage or platform, whereby the lift car is elevated numerous times to the very same height. It is therefore desirable to provide a control mechanism by which the maximum elevational height of the lift can be set in advance, or programmed, thereby automatically stopping the lift at the stage height repeatedly and consistently. The wheel chair lift device disclosed in assignee's prior U.S. Pat. No. 7,926,618 discloses a height adjustment mechanism accessible through a panel of the lift car for varying the elevational height of the lift. A rotatable arm is used to set the elevational height, and a knob secured to the end of such rotatable arm slides within a circular slot. The knob can be loosened to move the knob within the circular slot, thereby repositioning the rotatable arm. Once the knob is set to the desired elevational height, the knob is re-tightened, and the access panel is closed.

An alternate height adjustment mechanism is disclosed in assignee's U.S. Pat. No. 7,721,850 for use with a fixed-installation lift, wherein a cable attached to an actuator moves the actuator as the lift car moves, the actuator eventually engaging a microswitch when the lift reaches the desired maximum height. Adjustment of the maximum desired height requires an installer to adjust the relative position of the microswitch along a rail traversed by the actuator.

Portable wheelchair lifting devices generally require that the height to which the lift car is elevated be readily adjustable. Such lift devices are frequently moved from one stage or platform to another, and the elevations of two or more stages or platforms often differ from one another. On the other hand, once a portable lift is transported to a particular location, and the maximum height has been re-adjusted to suit the particular platform or stage at the new location, further height adjustments are neither required nor recommended.

Therefore, it is important to be able to quickly and easily adjust the maximum height to which the lift is elevated each time the lift is moved to a different platform or stage. Once the maximum height is set for the new stage or platform, it is also important that the lift should be able to raise the platform of the lift device repeatedly, and reliably, to the pre-set maximum height. Clearly, it would be advantageous to be able to verify that the mechanism used to signal that the maximum height has been reached is, in fact, operational before permitting the lift car to elevate; if the maximum height detection system is not working properly, and the lift is permitted to be elevated, the lift will not automatically stop when it reaches the desired maximum height.

In view of the foregoing, it is an object of the present invention to provide a wheel chair lift device suitable for lifting wheelchair-bound users up to the height of stages, platforms, risers and the like in a safe and reliable manner, and comporting with all applicable ADA requirements.

Another object of the present invention is to provide such a lift device which has a relatively low profile to avoid interference with viewing by an audience and/or spectators in an auditorium or other facility where events are held.

Still another object of the present invention is to provide such a wheel chair lift device which makes efficient use of forces applied by hydraulic cylinders to minimize the size, weight and cost of such hydraulic cylinders, and the pump and motor used to power them, while still supporting the lift car in a stable manner.

Yet another object of the present invention is to provide such a wheel chair lift device which minimizes the number of exposed moving components around and below the lift device.

A further object of the present invention is to provide such a lift device which does not require a protective skirt to protect persons nearby from injury and/or to shield foreign objects that would otherwise become caught within the lifting mechanism.

A still further object of the present invention is to provide such a lift device which avoids the need for chains or gears in order to raise or lower the lift car.

Another object of the present invention is to provide such a lift device that is relatively inexpensive, easy to construct and use, and simple to maintain.

Still another object of the present invention is to provide such a lift device that is provided in a form that is easy to transport, and which can be collapsed to pass through narrow openings.

Yet another object of the present invention is to provide such a lift device wherein the lift car floor can be sufficiently lowered to the ground to avoid the need for an entry ramp, while avoiding deformation of the lift car side walls away from their usual vertical orientation.

These and other objects of the present invention will become more apparent to those skilled in the art as the description of the present invention proceeds.

SUMMARY OF THE INVENTION

Briefly described, and in accordance with preferred embodiments thereof, the present invention relates to a lift device used to provide access to a stage, platform, or the like for individuals with disabilities, including persons who rely upon wheelchairs or crutches to move about. The lift device includes a base for resting on the ground, and first and second guide members attached to, and extending generally vertically upward from, opposing sides of the base. A lift car is provided to support and elevate an occupant of a wheelchair. This lift car includes a structural frame, as well as a floor panel supported between the lower portions of first and second opposing sides of the structural frame.

A pair of hydraulic cylinders are provided to raise and lower the lift car. The first hydraulic cylinder includes a closed end and an opposing open end; a first piston rod is extendable from the open end. The closed end of the first hydraulic cylinder is attached to one side of the lift car structural frame, while the free end of the first piston rod is attached to a corresponding side of the base, with the first hydraulic cylinder and first piston rod being oriented substantially vertically. Likewise, a second hydraulic cylinder includes a second piston rod extendable therefrom. The closed end of the second hydraulic cylinder is attached to the other side of the lift car structural frame, while the free end of the second piston rod is attached to the other side of the base; the second hydraulic cylinder and second piston rod also have a substantially vertical orientation. The first and second piston rods are extended and retracted from the first and second hydraulic cylinders to raise and lower the lift car, respectively. As the lift car moves up and down, the first and second hydraulic cylinders move up and down with it. In this configuration, the first and second hydraulic cylinders are mounted "upside-down" as compared to typical installations, since the hydraulic fittings on such cylinders actually move up and down together with the lift car.

The vertical guide members include hollow internal channels. In the preferred embodiment, the vertical guide members are formed of generally rectangular, or square, tubular stock, although such guide members could also be formed of C-channel stock or rounded tubular stock. The open ends of the hydraulic cylinders extend within the hollow internal channels of the vertical guide members. Thus, as the lift car moves down, the hydraulic cylinders are lowered further into their associated vertical guide members. Alternatively, as the lift car moves up, the extended portions of the piston rods lie entirely within the hollow internal channels of the guide members. In this manner, the lift device of the present invention minimizes exposed moving parts, and better protects the hydraulic cylinders and piston rods.

In the preferred embodiment, the first and second vertical guide members are received within the first and second sides of the structural frame of the lift car. In other words, as the lift car is lowered to the ground, the vertical guide members become housed at least partially within the side walls of the lift car. To maintain a low profile, the closed ends of the first and second hydraulic cylinders are preferably attached to upper portions of the first and second opposing sides of the lift car structural frame. To stabilize the lower portions of the lift car, each side of the lift car structural frame preferably includes a pair of rollers pivotally mounted to the lower portion thereof. The rollers on each side of the structural frame engage opposing vertical faces of the vertical guide member associated with that respective side of the lift car. These rollers roll upon such vertical faces as the lift moves up and down, but restrict lateral movement of the lift car.

Attachment of the closed ends of the hydraulic cylinders to the lift car structural frame in the "upside-down" configuration described above leads to further unexpected advantages. The wheel chair lift device includes a series of hydraulic circuit components used to operate the hydraulic cylinders. These components preferably include: 1) a reservoir of hydraulic fluid; 2) a hydraulic pump coupled to the reservoir for pressuring hydraulic fluid; 3) a motor for rotating the hydraulic pump; and 4) hydraulic tubing coupled between the hydraulic pump and fittings on the first and second hydraulic cylinders for conveying the hydraulic fluid used to extend and retract the first and second piston rods. Since the fittings on the hydraulic cylinders move up and down together with the lift car, all of the aforementioned hydraulic circuit components (reservoir; pump; motor; and tubing) are preferably supported by, and travel up and down together with, the lift car. Accordingly, those portions of the hydraulic tubing which are housed within the first and second sides of the lift car structural frame are preferably formed of rigid tubing. In the preferred embodiment, such rigid tubing includes the hydraulic tubing that is attached to the fittings on the first and second hydraulic cylinders, and which is lowered into the hollow internal channels of the vertical guide members as the lift car is lowered to the ground. If desired, however, portions of hydraulic tubing which extending below the floor panel of the lift car, to cross from one side of the lift car structural frame to the other side of the lift car structural frame, may be flexible hoses to allow for collapsing of the structural frame of the lift car for purposes of transport.

DETAILED DESCRIPTION OF THE PREFERRED EMBODIMENTS

Figure 1:
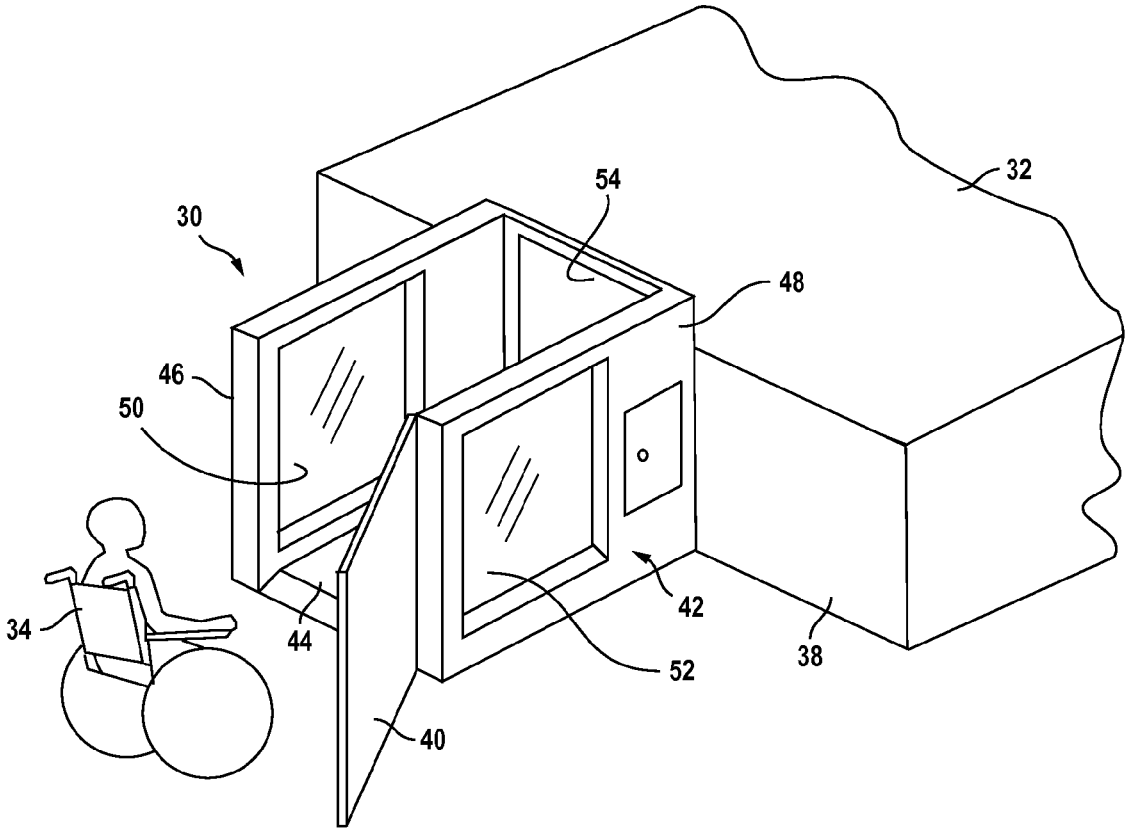
FIG. 1 is a perspective view of the wheelchair lift device of the present invention positioned adjacent an auditorium stage for lifting a wheelchair occupant up to stage level.

A wheel chair lift device constructed in accordance with a preferred embodiment of the present invention is designated generally within FIG. 1 by reference numeral 30. Lift device 30 is adapted to provide access to an elevated stage or platform 32 by a disabled individual, e.g., wheel chair occupant 34. Lift device 30 is positioned adjacent wall 38 of platform 32. As shown in FIG. 1, front entry gate 40 of lift device 30 is opened, and individual 34 can board lift car 42 by wheeling onto lift car floor 44. Lift car 42 includes two opposing side walls 46 and 48, each provided with a transparent window 50 and 52, respectively. A rear exit gate 54 can be opened after lift car 42 is elevated sufficiently to raise lift car floor 44 to the same height as platform 32 for allowing individual 34 to wheel onto platform 32. This procedure can be reversed when individual 34 wishes to return back to ground level.

Figure 2:
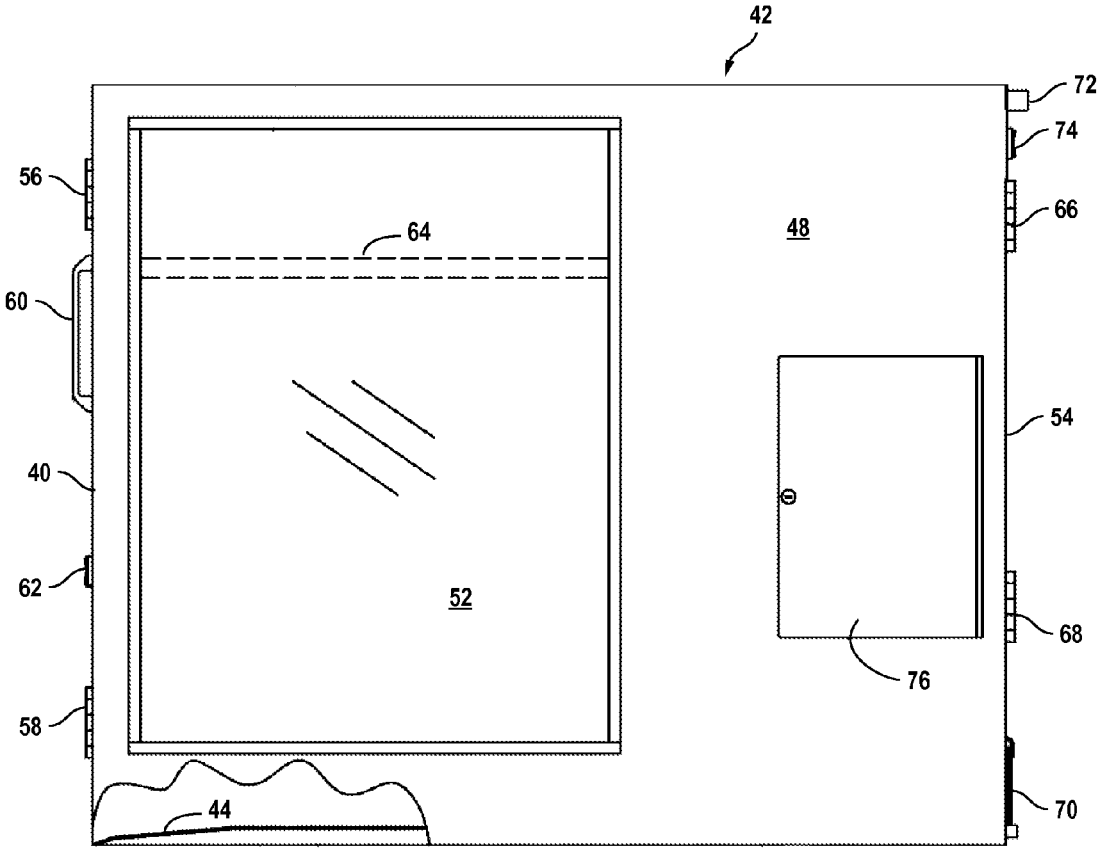
FIG. 2 is a side view of the wheelchair lift device in its lowered position, and partially cut-away to reveal the platform of the lift car.

FIG. 2 is a side view of lift car 42 in its lowered position. Front entry gate 40 is hinged to side wall 48 by hinges 56 and 58. Handle 60 is provided on the exterior of front entry gate 40 to aid in opening front entry gate 40. Up-down toggle switch 62 is provided adjacent entry gate 40 to cause lift car 42 to be raised or lowered. A grab bar, shown by dashed lines 64 through window 52, extends across the length of lift car 42 to aid a user. At the other end of lift car 42, rear exit gate 54 is hinged to side wall 48 by hinges 66 and 68. A hinged dock plate 70 is provided at the lower end of rear exit gate 54; hinged dock plate 70 pivots downwardly to meet with platform 32 as rear exit gate 54 is opened. Handle 72 is provided on the exterior of rear exit gate 54, and another up-down toggle switch 74 is provided adjacent rear exit gate 54 to cause lift car 42 to be raised or lowered. Panel 76 is secured to the exterior of side wall 48, and in the case of a power loss, panel 76 may be removed to permit access to a hand-operated hydraulic pump for safely lowering lift car 42 back to the ground.

Figure 3:
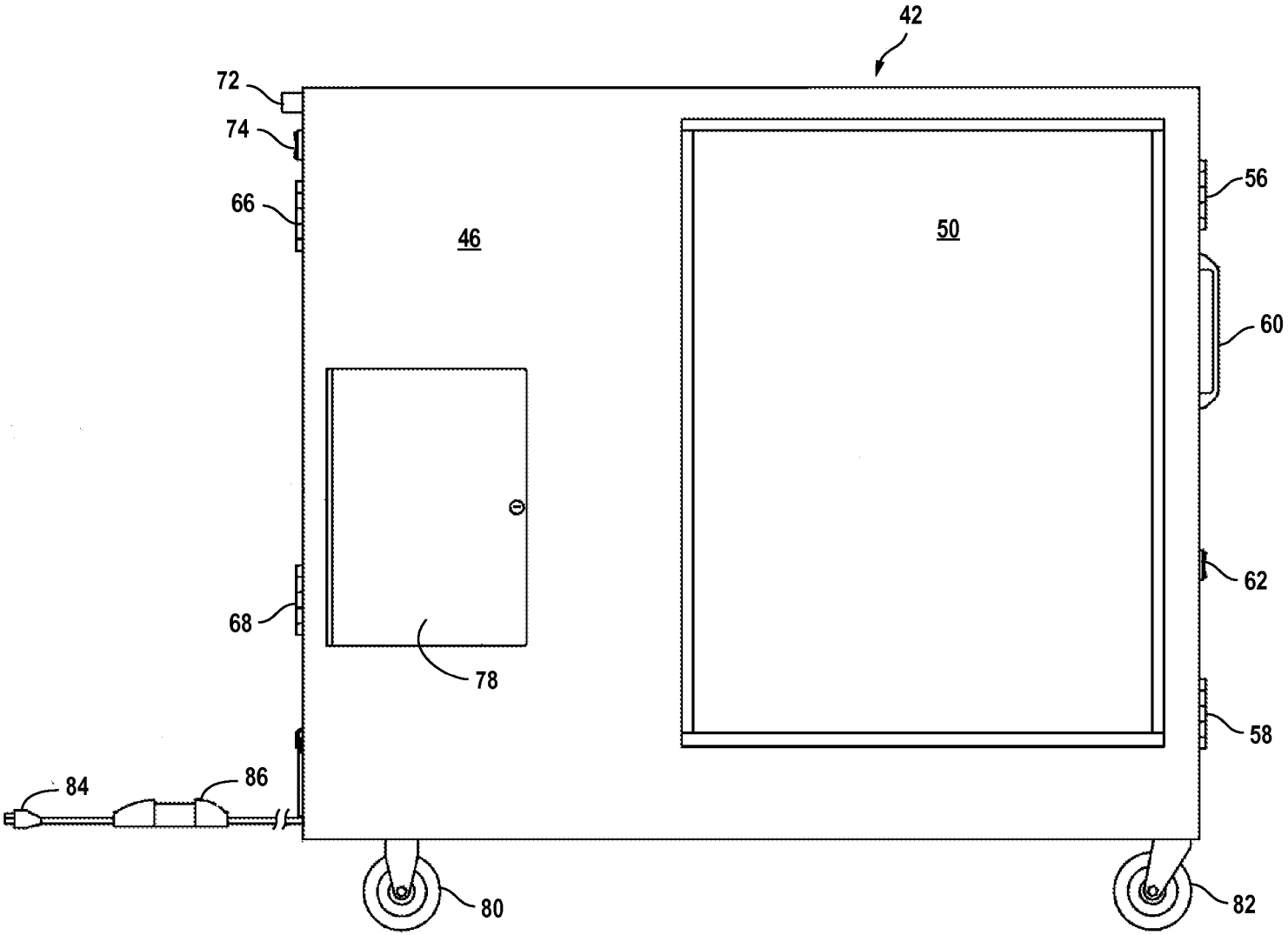
FIG. 3 is a side view of the wheelchair lift device similar to that shown in FIG. 2 and further including caster wheels installed below the lift car for transport.

FIG. 3 is a side view of lift car 42 as viewed from the opposite side as that shown in FIG. 2. In FIG. 3, removable access panel 78 permits access to a storage area wherein four casters are stored for use when transporting lift device 30. Indeed, in FIG. 3, such casters, including rigid caster 80 and swivel caster 82, are installed on the bottom of lift car to facilitate transport of lift device 30. Also visible within FIG. 3 is an electrical power cord 84, including a ground fault circuit interrupter (GFCI) 86, used to supply electrical power for operating lift device 30.

Figure 4A:
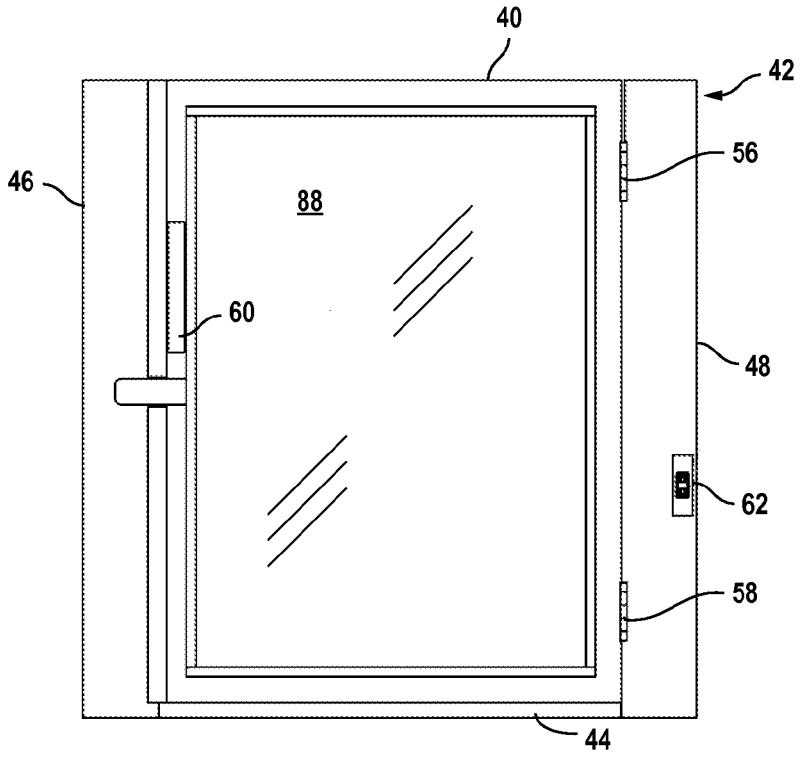
FIG. 4A is an end view of the wheelchair lift device and depicting the front end of the lift device through which a user enters or exits when the lift car is fully-lowered.
Figure 4B:
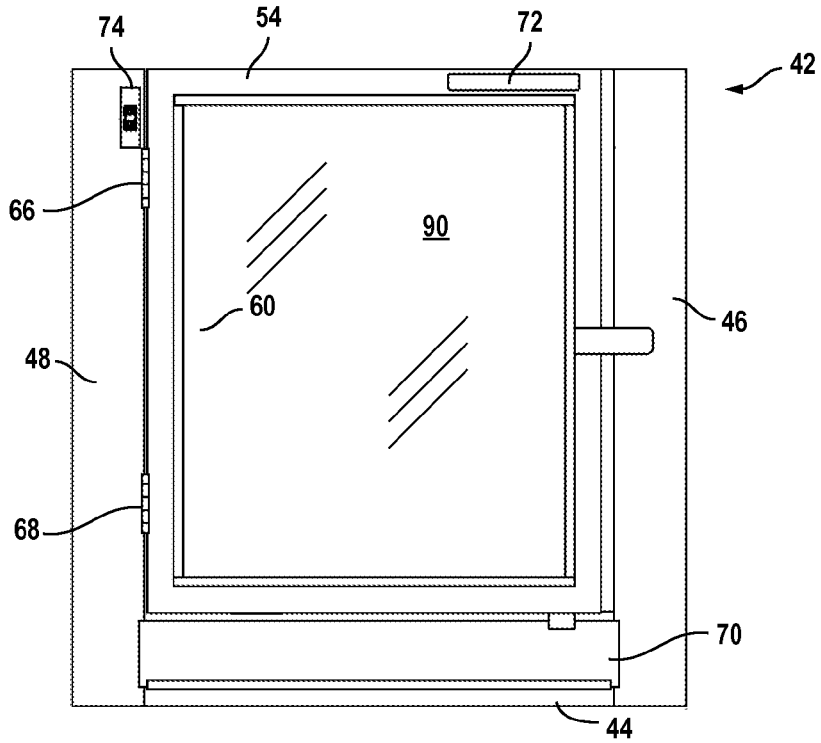
FIG. 4B is an end view of the wheelchair lift device and depicting the rear end of the lift device through which a user enters or exits when the lift car is elevated to stage level.

FIGS. 4A and 4B are end views of lift car 42, and show the front entry gate 40 and rear exit gate 54, respectively. Front entry gate 40 preferably includes a transparent window 88 of high-impact thermoplastic; likewise, rear exit gate 54 includes a transparent window 90 formed of high-impact thermoplastic.

Figure 5:
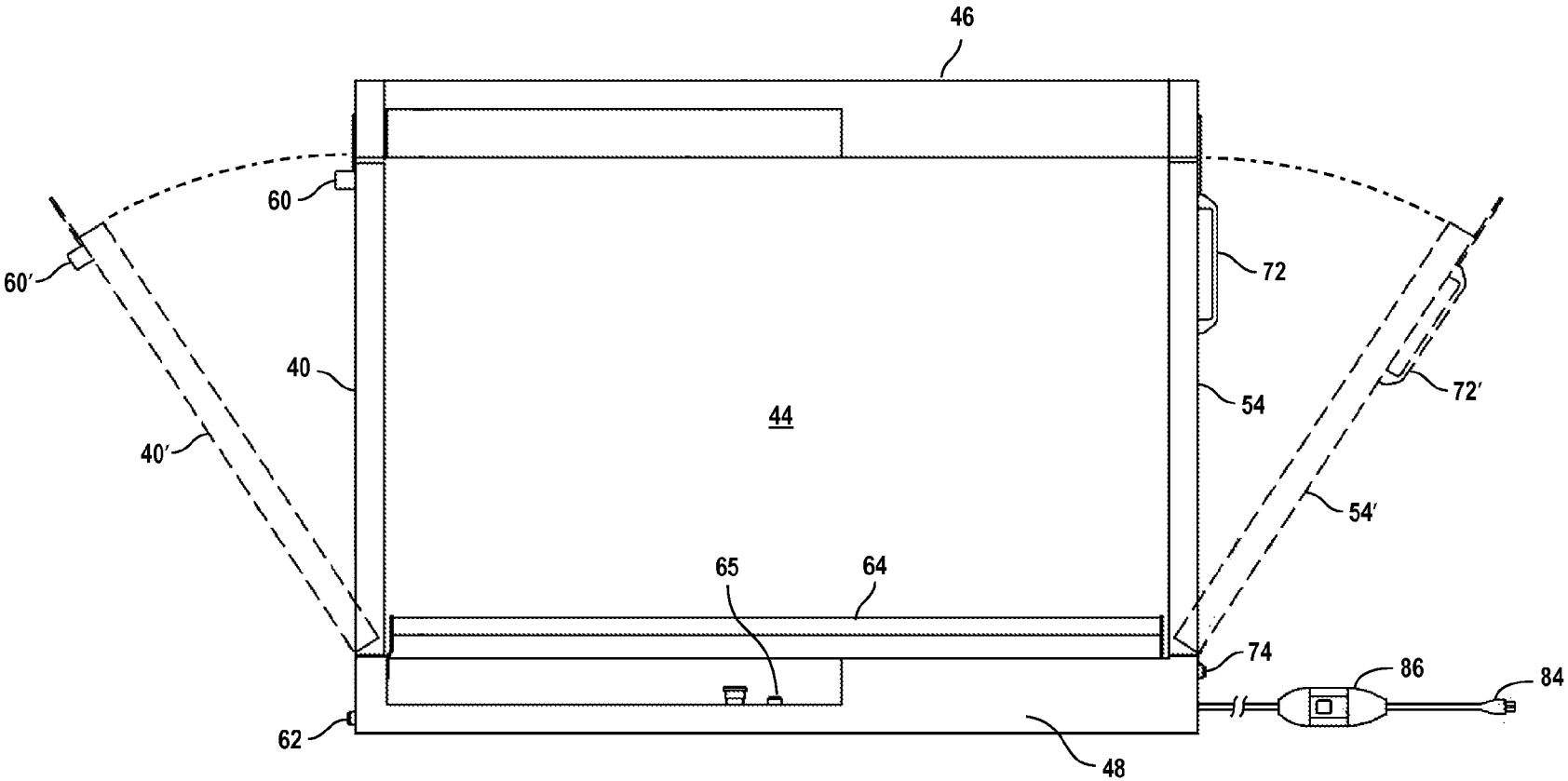
FIG. 5 is a top view of the wheelchair lift device and illustrating, in phantom lines, how the front gate and rear gate of the lift car swing open.

FIG. 5 is a top view of lift car 42. Front entry gate 40 is shown in solid lines in its closed position, and in dashed lines in an opened position. Rear exit gate 54 is likewise shown in solid lines in its closed position, and in dashed lines in an opened position.

Figure 6A:
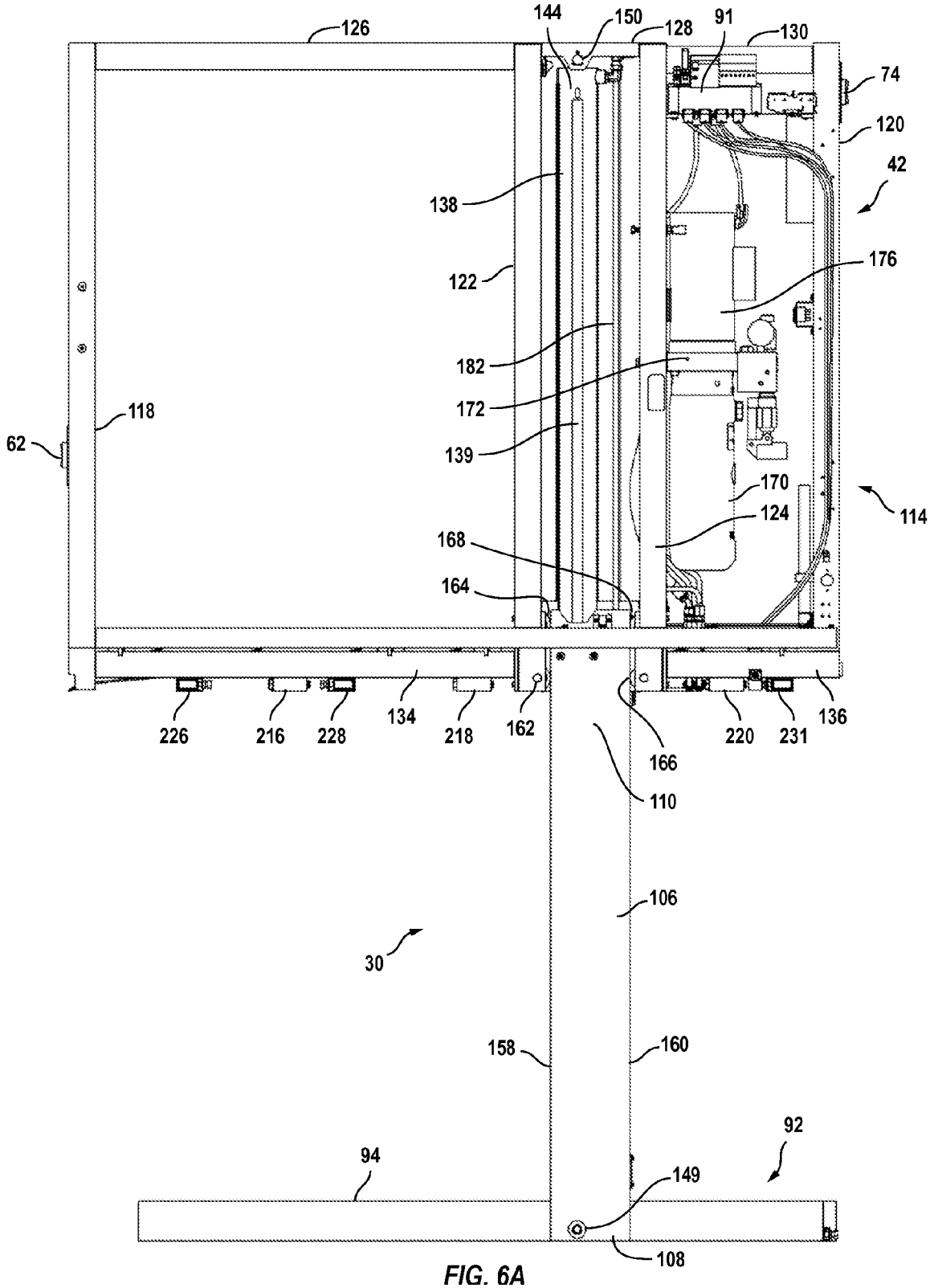
FIG. 6A is a side view of the wheelchair lift device in an elevated position, and with several components omitted to reveal internal features.
Figure 7:
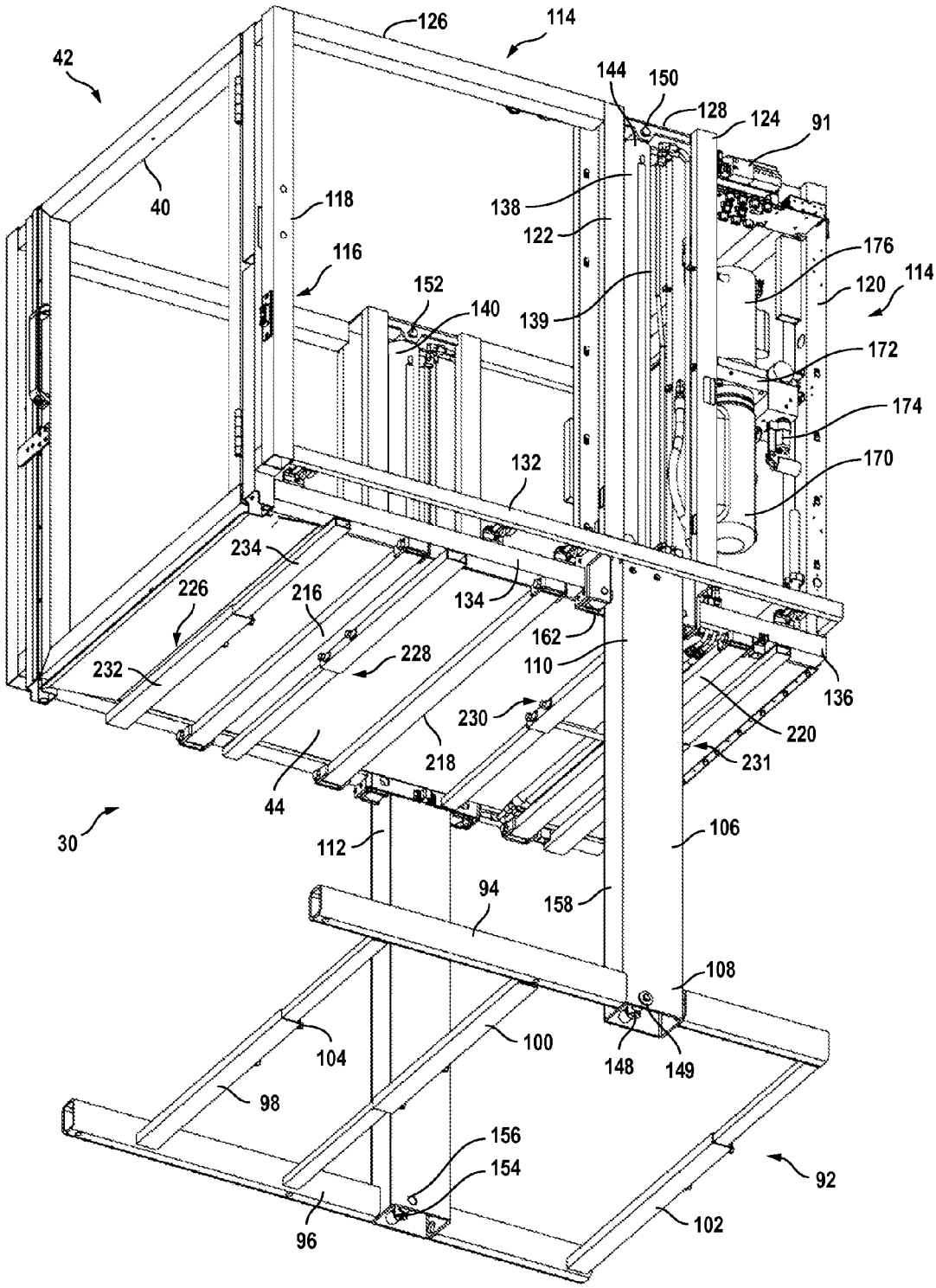
FIG. 7 is a perspective view of the wheelchair lift device in an elevated position as viewed from below the lift device to reveal a framework used to support the platform of the lift car, and wherein several components have been omitted to reveal internal features.
Figure 8:
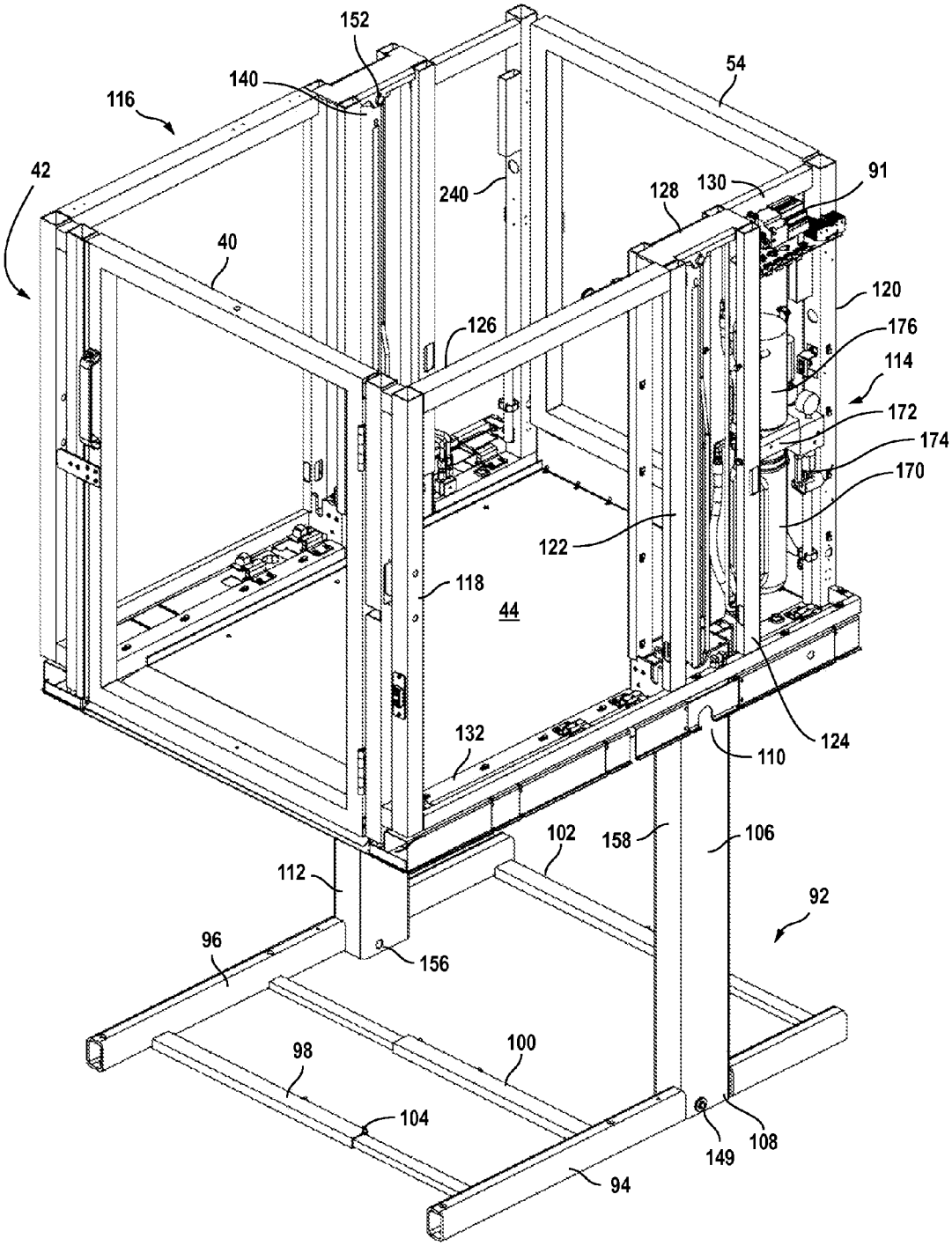
FIG. 8 is a perspective view of the wheelchair lift device in an elevated position as viewed from above the lift device, and wherein several components have been omitted to reveal internal features.

Turning now to FIGS. 6A. 6B and 6C, lift device 30 is shown with lift car 42 in an elevated position, and wherein the decorative/protective skins that usually cover side walls 46 and 48 removed. It may now be seen that lift device 30 includes a base 92, including base side member 94, for resting upon a floor when the wheelchair lift is in use. It will be noted briefly that base 92 is actually lifted off of the floor when, as shown in FIG. 3, the caster wheels are installed for transporting lift device 30. Referring briefly to FIGS. 7 and 8, it will be seen that base 92 also includes an opposing base side member 96 opposite base side member 94, and that base side members 94 and 96 are interconnected by base cross members 98, 100 and 102. As shown in FIGS. 7 and 8, these cross members are preferably formed as telescoping members for allowing the length of such cross members to be adjusted. Fastening screws, such as screw 104, can be loosened to set the length of such cross members, and then tightened to maintain the desired length. Construction of cross members 98, 100 and 102 in this manner helps to allow lift device 30 to be collapsed to a narrower width when being transported through narrow passageways.

Referring jointly to FIGS. 6A through 8, a first guide member 106 extends generally vertically upward from base side member 94. First guide member 106 includes lower end 108 and upper end 110. Lower end 108 of first guide member 106 is fixedly coupled to base side member 94. Similarly, a second guide member 112 is secured at its lower end to base side member 96, and extends generally vertically upward therefrom. In the preferred embodiment, the tubular members forming base 92 and guide members 106 and 112 are all formed of ASTM A36 steel. Unless otherwise described, the joints attaching such members to each other are formed by welding. In the preferred embodiment, guide members 106 and 112 are of rectangular cross-section and each include a hollow internal channel.

Still referring to FIGS. 6A-6C, 7 and 8, lift car 42 includes a structural frame that has two opposing sides 114 and 116. First side 114 is a generally rectangular shape including outer vertical members 118 and 120, inner vertical members 122 and 124, upper horizontal members 126, 128, and 130, and lower horizontal members 132, 134 and 136. First side 114 extends generally vertically from lower horizontal members 132, 134, and 136 to upper horizontal members 126, 128 and 130. Second side 116 is essentially a mirror image of first side 114. The manner in which first and second sides 114 and 116 are interconnected below lift car floor panel 44 will be described later.

In the preferred embodiment, lift car 42 is raised and lowered by a first hydraulic cylinder 138 and a second hydraulic cylinder 140. First hydraulic cylinder 138 has a closed upper end, or butt end, 144, and an opposing lower open end 146. First hydraulic cylinder 138 has a piston rod 142 extendable from lower open end 146 (see FIGS. 6B and 6C). Piston rod 142 has a free end 148 extendable away from first hydraulic cylinder 138, and an opposing captive end which remains within first hydraulic cylinder 138 at all times. Butt end 144 of first hydraulic cylinder 138 includes a tubular mounting bracket 145 (see FIG. 9) for receiving bolt 150 which secures butt end 144 to upper structural frame member 128; thus, first hydraulic cylinder 138 moves up and down along with lift car 42. Free end 148 of piston rod 142 is secured by bolt 149 to lower end 108 of vertical guide member 106, and hence, to base 92; in this sense, free end 148 of piston rod 142 is fixedly coupled to a first side of base 92. Also visible within FIG. 6A is an adhesive-backed plastic strip 139 secured vertically along cylinder 138 facing away from the center of lift car 42. If desired, two more plastic strips may be similarly secured along cylinder 138, facing inward (i.e., toward the center of lift car 42), and facing forward (i.e., toward vertical frame member 118), respectively. Plastic bumpers (not shown) may also be secured on the corresponding inner walls of guide member 106 near its upper end 110, i.e., on the forwardmost inner wall of guide member 106, and on the two inner walls perpendicular thereto). While contact between cylinder 138 and guide member 106 is preferably avoided altogether, the presence of such plastic strips and corresponding plastic bumpers ensures that any sliding contact which does result will avoid metal-to-metal scraping. To some extent, such plastic-to-plastic engagement may help further stabilize the lift when elevated.

Similarly, second hydraulic cylinder 140 has its butt end secured to the upper portion of second side 116 of the lift car structural frame by bolt 152 (see FIGS. 7 and 8); thus, second hydraulic cylinder 140 likewise moves up and down along with lift car 42. A piston rod likewise is extendable downwardly from the lower end of second hydraulic cylinder 140, and the free end 154 (see FIG. 7) of this piston rod is secured by bolt 156 to the lower end of vertical guide member 112, and hence, to base 92; in this sense, free end 148 of piston rod 142 is fixedly coupled to a second side of base 92. As will be clear to those skilled in the art, pressurized hydraulic fluid can be selectively applied to fittings on hydraulic cylinders 138 and 140 to either extend or retract their respective piston rods. Since the free ends of such piston rods are fixedly attached to base 92, extension of such piston rods forces hydraulic cylinders 138 and 140, and hence lift car 42, upwardly. In contrast, retraction of such piston rods within hydraulic cylinders 138 and 140 lowers lift car 42 back toward the ground.

It will be noted that both of the hydraulic cylinders 138 and 140 are oriented vertically, and such hydraulic cylinders directly drive lift car 42. If the piston rods of such cylinders are extended by one additional inch, then lift car 42 raises by one additional inch. Moreover, it should be noted that hydraulic cylinders 138 and 140 are effectively mounted "upside-down" compared to typical uses of such hydraulic cylinders. In a typical lift device, the butt ends of the hydraulic cylinders are secured to a fixed structure, and the free ends of the movable piston rods are secured to the car or platform that elevates. However, in the preferred embodiment of the present invention, the typical configuration is reversed. Unexpected benefits of reversing the typical configuration are discussed below.

Still referring jointly to FIGS. 6A-6C, 7 and 8, the upper end 110 of first guide member 106 is received within first side 114 of the lift car structural frame. More specifically, upper end 110 of guide member 106 extends just inside lower horizontal frame member 132, and between vertical frame members 122 and 124. As lift car 42 is lowered further toward base 92, guide member 106 continues to be received within first side 114 of the lift car structural frame until, when lift car 42 is fully-lowered, upper end 140 of guide member 106 lies closely proximate to upper frame member 128. Likewise, second guide member 112 is received with second side 116 of the lift car structural frame.

It will be recalled that one of the objects of the present invention is to provide a wheel chair lift wherein the lift car is highly stable, particularly when the lift is elevated. In this regard, rollers are provided at the lower ends of the first and second sides 114 and 116 of the lift car structural frame to engage vertical guide members 106 and 112 for allowing vertical movement of lift car 42, while maintaining the lower portion of lift car 42 in close alignment with guide members 106 and 112. First guide member 106 includes a vertical planar face 158, shown best in FIGS. 7 and 8. A similar vertical planar face 160 is provided on the opposite wall of guide member 106. Lower roller 162, and upper roller 164, are pivotally coupled to the lower end of vertical frame member 122 for rollingly engaging vertical face 158 of guide member 106. A second set of rollers 166 and 168 are likewise provided on the lower end of vertical frame member 124 for rollingly engaging opposing vertical face 160 of guide member 106. Preferably, the distance between the first set of rollers 162 and 164 and the second set of rollers 166 and 168 can be adjusted to closely match the distance between opposing vertical faces 158 and 160. Thus, as lift car 42 rises, lowers, or stays at any given height, all of such rollers are in close engagement with guide member 106 to maintain lift car 42 directly above base 92 at all times. While not shown in detail, it should be understood that identical rollers are provided proximate the lower end of second side 116 of the lift car structural frame to rollingly engage opposing faces of second guide member 112. While not shown in the drawings, rollers may also be provided, if desired, to engage one or both of the exterior faces of guide members 106 and 112 that lie perpendicular to vertical faces 158 and 160.

Figure 6B:
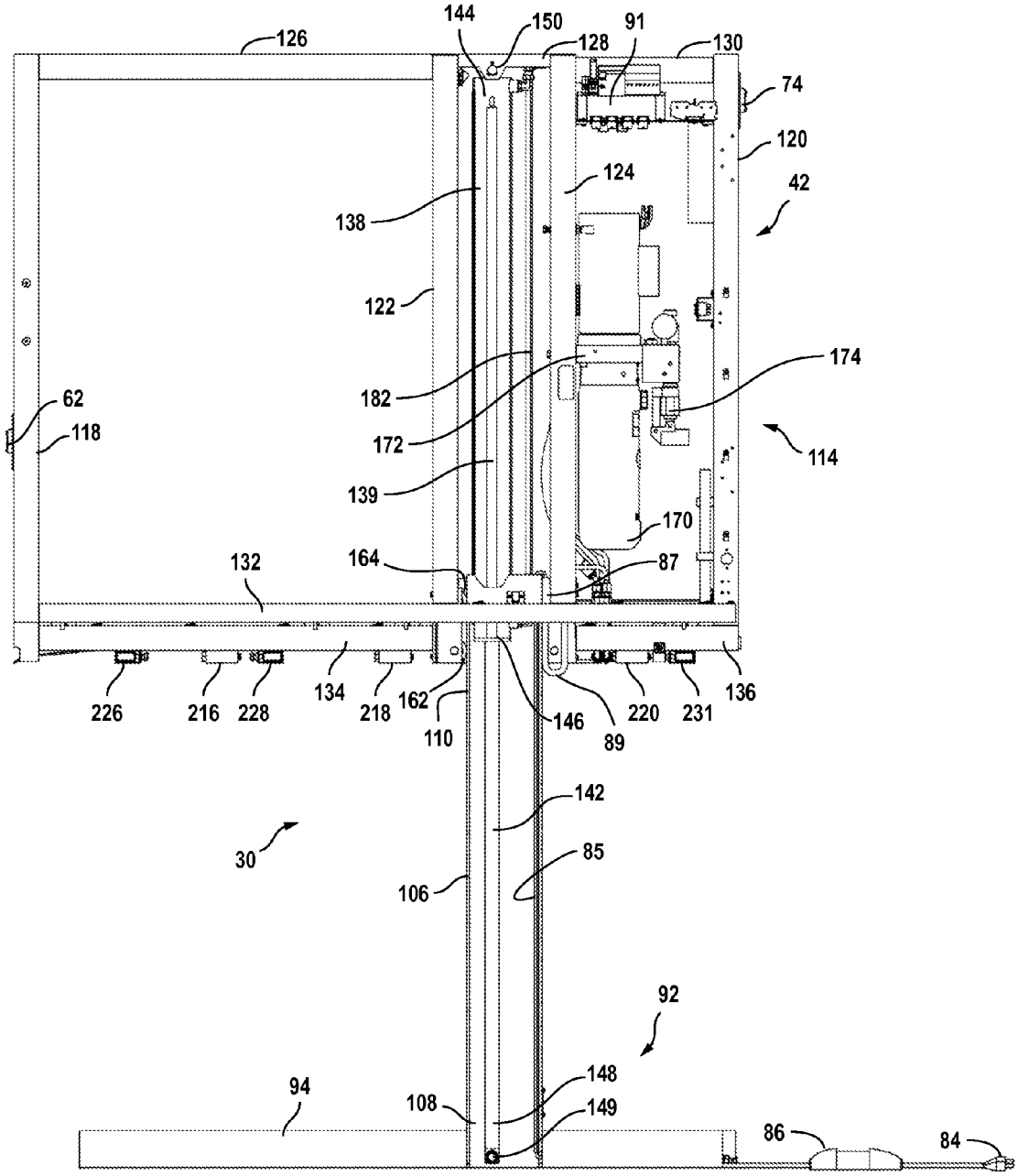
FIG. 6B is a sectional side view, similar to that of FIG. 6A, but wherein a tubular vertical support beam is sectioned to reveal a hydraulic piston rod extending therethrough.
Figure 6C:
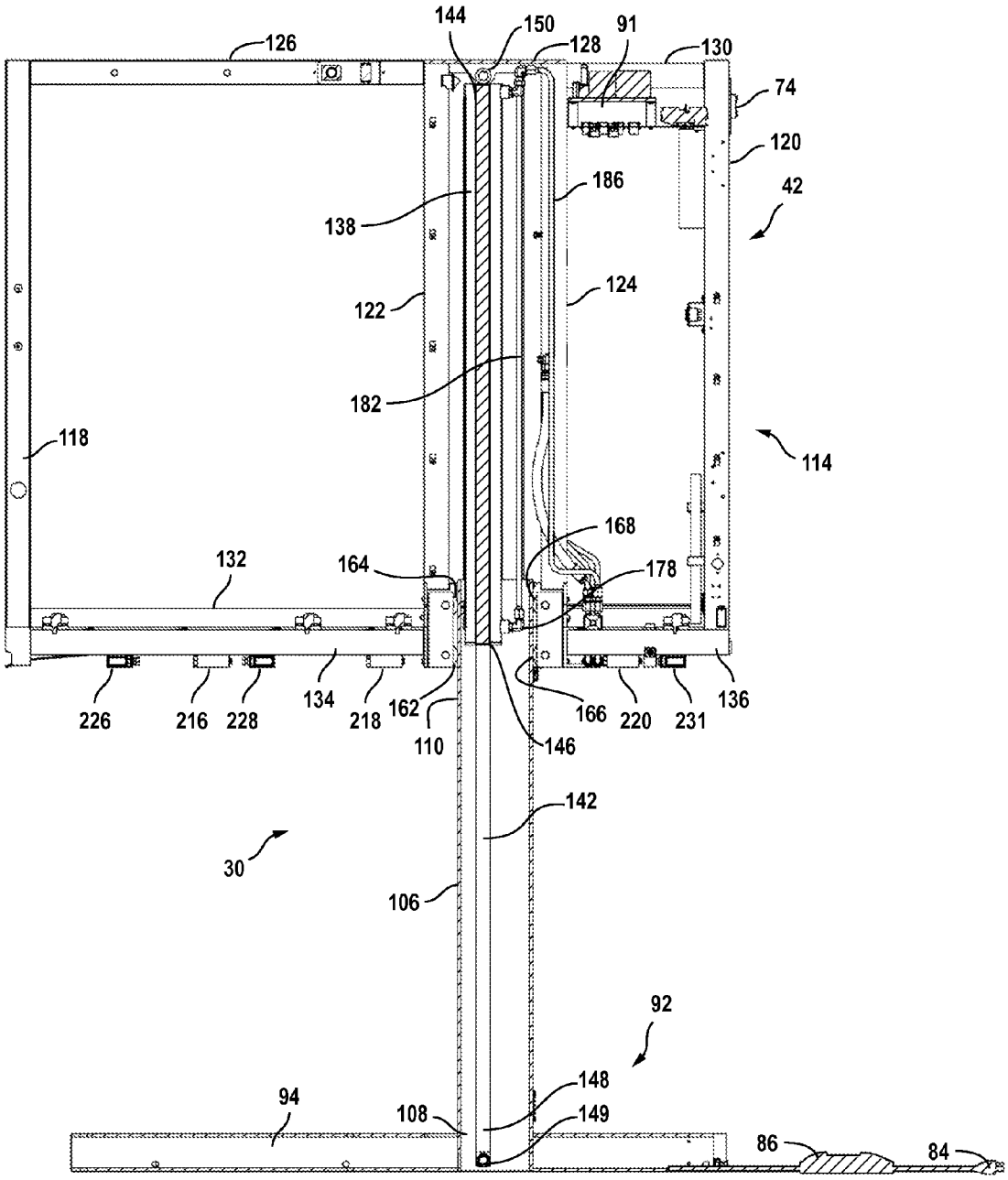
FIG. 6C is another sectional side view, similar to that of FIG. 6B, but wherein the hydraulic cylinder and lift car frame are sectioned, and wherein the hydraulic pump and associated electric motor are omitted to reveal the positioning of hydraulic tubing lines.

It will also be recalled that one of the objectives of the present invention is to provide a wheel chair lift device wherein no moving parts of the lift mechanism are exposed, apart from the lift car itself. In this regard, FIGS. 6A-6C illustrate that the lower, open end 146 of first hydraulic cylinder 138 extends into the hollow internal channel of first guide member 106 and moves therethrough as the lift car 42 moves up and down. Any extended portion of piston rod 142 is always enclosed within guide member 106. Likewise, the lower, open end of second hydraulic cylinder 140 extends within the hollow internal channel of second guide member 112 and moves therethrough as lift car 42 moves up and down; any extended portion of the piston rod associated with cylinder 140 is always enclosed within guide member 112. Thus, all moving parts of the lift mechanism are enclosed within either guide members 106/112 or within side walls 114/116 of lift car structural frame. Accordingly, apart from movement of lift car 42 itself, there are no other exposed moving parts that could injure a passerby or which could become intertwined with foreign objects.

Vertical guide members 106 and 112 are illustrated in the drawings as having a rectangular cross-section, surrounding a hollow, rectangular internal channel. Those skilled in the art will appreciate however, that the tubular stock from which vertical guide members 106 and 112 are made could be square tubing, circular tubing, or even C-shaped stock defining a C-shaped internal channel having one open face; in the latter instance, the open face preferably is directed toward the center of the lift, i.e., the two open faces of the two guide members are directed toward one another.

Earlier, it was noted that the mounting of the hydraulic cylinders in an upside-down configuration provides unexpected advantages. Referring again to the hydraulic component schematic of FIG. 9, the hydraulic circuit includes hydraulic fluid reservoir 170, a hydraulic pump/manifold unit 172, an emergency hand-operated pump 174 for use during electrical power outages, and an electric motor 176 coupled to hydraulic pump/manifold unit 172 for rotating the same to pressurize hydraulic fluid. In the preferred embodiment, electric motor 176 is a capacitor-start, ½ horsepower, 120 Volt AC motor, e.g., Leeson-brand Model No. A42C17NB11 available from the Leeson Electric division of Royal Beloit Corporation of Grafton, Wis. The hydraulic pump/manifold unit 172, manual pump 174, and fluid reservoir 170, are available from Bucher Hydraulics of Grand Rapids, Mich. While not shown in the drawings, a short length of tubing is inserted into a socket of manual pump 174 to provide leverage during use. As shown in FIGS. 6A-6C, 7 and 8, all of such hydraulic components are supported within first side 114 of the lift car structural frame, and move up and down together with lift car 42. As further indicated in the schematic drawing of FIG. 9, first cylinder 138 includes a lowermost fitting 178 and an uppermost fitting 180. Lowermost fitting 178 is coupled to the lower end of a section of rigid steel tubing 182. Rigid tubing 182 extends upwardly along, and parallel to cylinder 138; the upper end of rigid tubing 182 forms an inverted U-shape and mates with a flexible hose 184 connected to hydraulic pump/manifold unit 172. The upper fitting 180 of first cylinder 138 is coupled to rigid tube 186 which extends downwardly toward the bottom portion of the lift car structural frame, but is spaced further apart from first cylinder 138 as compared with tubing 182. The lower end of tubing 186 connects with a rigid "elbow" tube 188, which in turn couples to a flexible hose 190 that passes below the lift car floor to second side 116 of the lift car structural frame.

On second side 116, flexible hose 190 is coupled through rigid "elbow" tube 192 to another rigid tube 194. Rigid tube 194 extends upwardly from elbow tube 192, forms a U-shaped bend, and extends back downwardly parallel with, and closely proximate to second cylinder 140, finally connecting with lowermost fitting 196. At the upper end of second cylinder 140, rigid tubing 198 is coupled to uppermost fitting 200, and then extends downwardly to the lower portion of lift car 42, where it connects through a further elbow tube 202. The other end of elbow tube 202 is coupled with a second flexible hose 204 which again passes below the lift car floor back to first side 114. On first side 114, flexible hose 204 is coupled through elbow tube 206 to a flexible hose 210. Flexible hose 210 extends upwardly therefrom and connects back to hydraulic pump/manifold unit 172.

Figure 9:
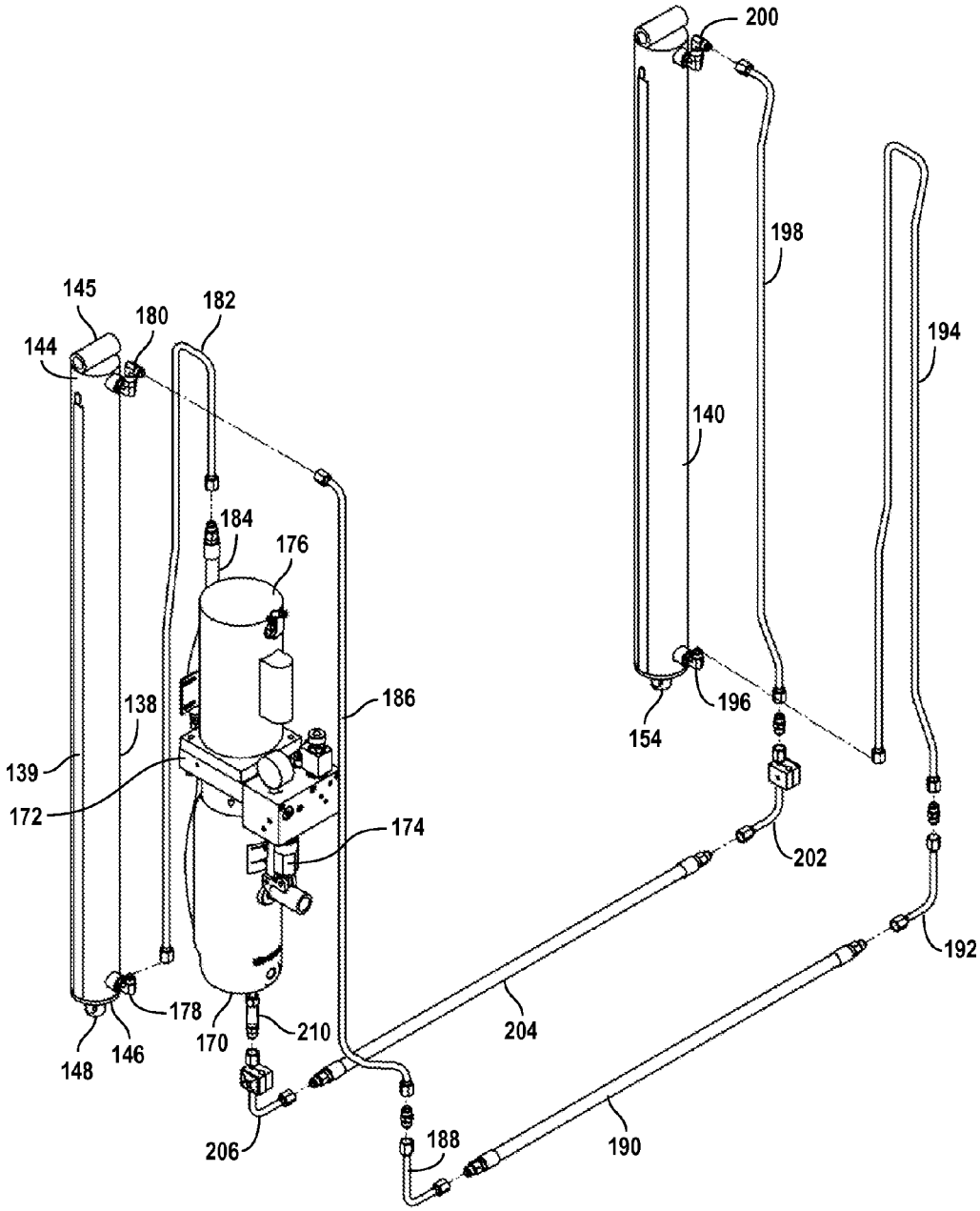
FIG. 9 is a perspective view which schematically illustrates the configuration of hydraulic tubing lines that extend below and around the lift car.

It may be noted that all of the components shown in FIG. 9, including all of the hydraulic tubing, are supported by lift car 42 and travel up and down together with lift car 42. Flexible hoses 190 and 204 are provided merely for allowing the width of lift car 42 to be collapsed, if desired, for transport through narrow passageways, without causing a need to disconnect any hydraulic tubing. On the other hand, if it is not necessary to collapse the width of the lift car (e.g., where lift device 30 is to be used only in conjunction with a single platform on a permanent basis), then flexible hoses 190 and 204 could instead be provided as rigid tubing.

As shown best in FIGS. 6A-6C, rigid tubing 182 is maintained closely proximate and parallel to first cylinder 138 as tubing 182 passes downwardly toward lowermost fitting 178. This ensures that, as lift car 42 is lowered, and cylinder 138 is received within the hollow internal channel of first guide member 106, there will be no interference, or binding, between tubing 182 and the inner walls of guide member 106. Likewise, the vertical portion of rigid tubing 194 that couples to lowermost fitting 196 on cylinder 140 (see FIG. 9) is maintained closely proximate and parallel to second cylinder 140 as lift car 42 is lowered, and cylinder 140 is received within the hollow internal channel of second guide member 112. This again ensures that there will be no interference or binding between tubing 194 and the inner walls of guide member 112. Were it necessary to use flexible hoses in place of rigid tubing 182 and 194 to allow for relative movement between hydraulic components, such hoses could flex in a manner that would interfere with the free movement of cylinders 138 and 140 within guide members 106 and 112, respectively.

Figure 12A:
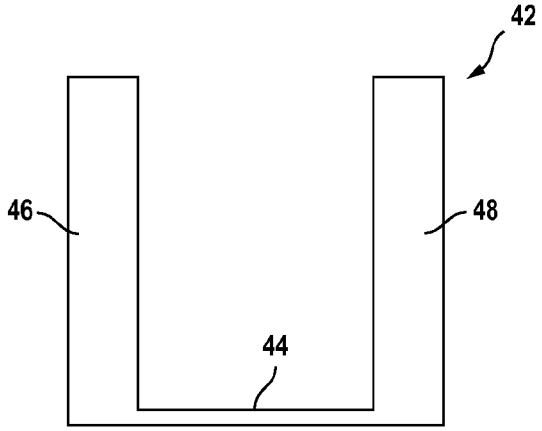
FIGS. 12A, 12B and 12C are schematic figures which illustrate how loading the platform of the lift car can deform the normally vertical orientation of the lift car, and how such problem is addressed in the preferred embodiment of the present invention.
Figure 12B:
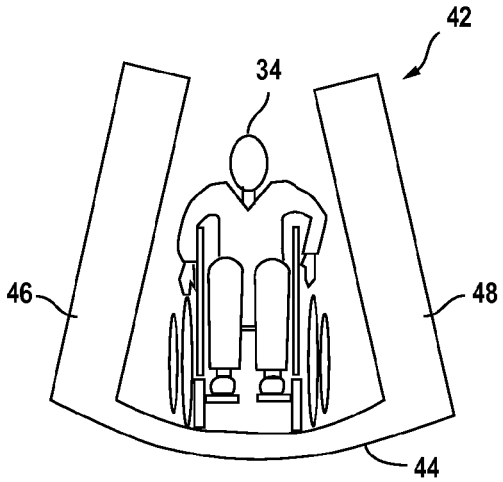
Figure 12C:
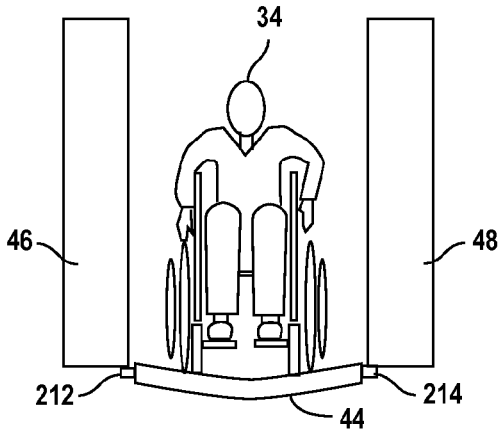

It will be recalled that another object of the present invention is to support lift car 42 for elevation in a manner that will maintain side walls 46 and 48 (see FIG. 1) in a vertical orientation when lift car 42 is elevated and under load. Referring to FIGS. 12A-12C, FIG. 12A shows lift car 42 in an unloaded condition; side walls 46 and 48 are vertical and parallel to each other, as desired. In FIG. 12B, wheel chair occupant 34 is shown supported in lift car 42, with lift car 42 in an elevated position; under load, lift car floor 44 bows downwardly, creating a twisting moment upon the base of side walls 46 and 48. This twisting moment rotates side walls 46 and 48 away from their original vertical orientation, causing the upper portions of side walls 46 and 48 to tilt toward one another. When occupant 34 wishes to exit lift car 42 onto a stage or platform, side walls 46 and 48 tend to pinch the rear exit gate, interfering with the opening thereof. This problem would not arise if the lifting force were applied directly below lift car floor 44. However, as explained earlier, it is advantageous to avoid the need to position the lifting mechanism directly below lift car 42 in order to allow lift car floor 44 to be lowered as close to the ground as possible, thereby avoiding the need for a separate entrance ramp. Accordingly, it is preferred to apply the lifting force to side walls 46 and 48, and indirectly couple such lifting force to lift car floor 44.

Figure 18:
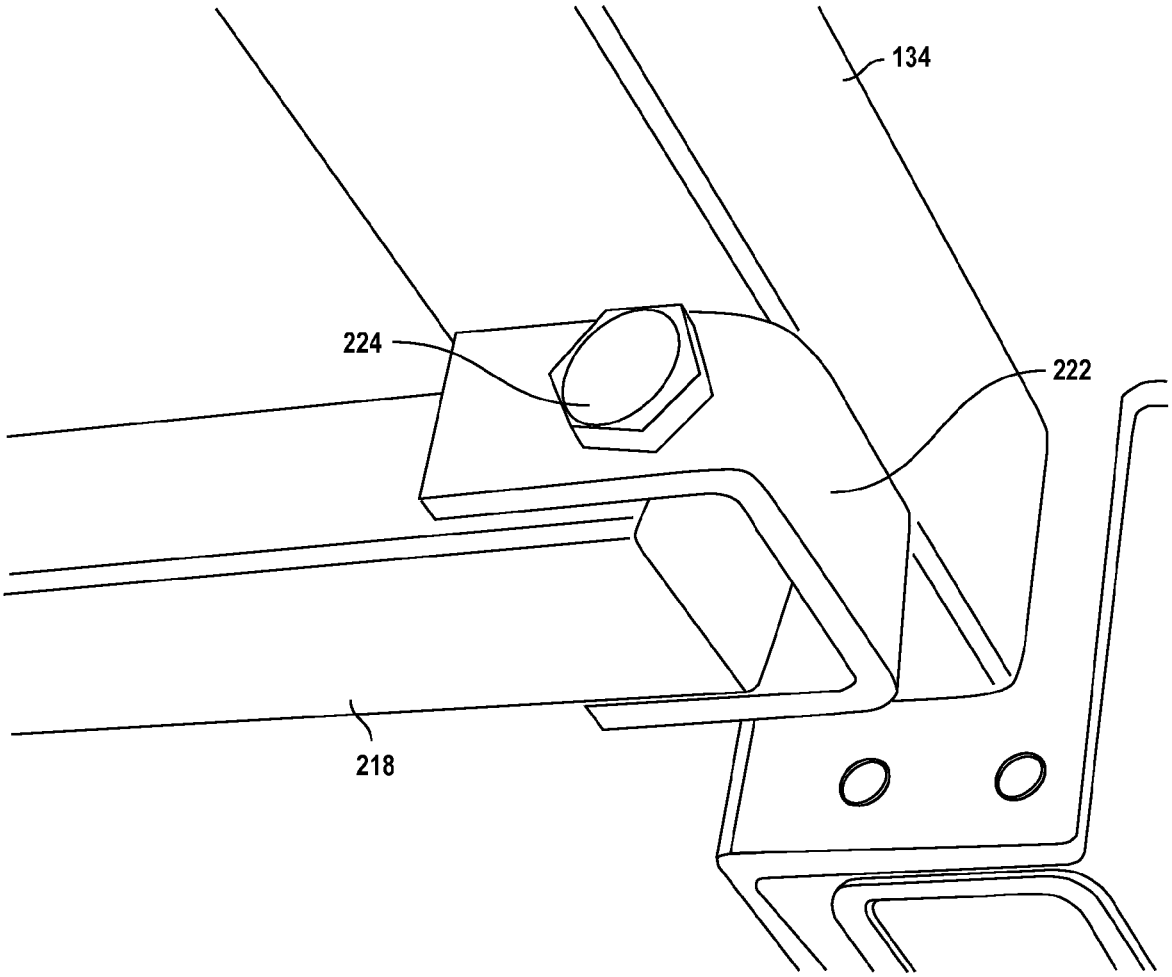
FIG. 18 is a partial perspective close-up view of one of the pivot-mounted flooring struts used to support the lift car floor from the lift car frame.

As shown in FIG. 12C, the problem of deforming side walls 46 and 48 out of their original vertical orientation can be resolved by coupling lift car floor 44 to side walls 46 and 48 in a manner which allows the sides of lift car floor 44 to pivot relative to side walls 46 and 48. Within the schematic drawing of FIG. 12C, pivot links 212 and 214 pivotally couple the opposing sides of lift car floor 44 to the lower portions of side walls 46 and 48 so that deformation of floor 44 under load is not coupled to side walls 46 and 48, thereby avoiding the problem of pinching the rear exit gate. In practice, a series of floor support struts 216, 218, and 220 (see FIGS. 6A-6C and FIG. 7) extend below car lift floor panel 44 for supporting floor panel 44. Each of such floor support struts 216, 218, and 220 has a first end pinned, i.e., pivotally connected, to a lower horizontal frame member of first side 114 of the lift car structural frame, and has a second opposing end pinned to a lower horizontal frame member of second side 116 of the lift car structural frame. For example, along side 114, floor support struts 216 and 218 are pinned to lower frame member 134, while floor support strut 220 is pinned to lower frame member 136. Turning briefly to FIG. 18, one end of floor support strut 218 is shown in greater detail. A U-shaped yoke 222 receives a first end of floor support strut 218. Yoke 222 is rigidly connected, as by welding, to the underside of frame member 134. The shaft of bolt 224 passes through aligned apertures formed in the end of floor support strut 218 and yoke 222. Yoke 222 includes two parallel flanges, and the aperture formed in the flange that is furthest from the head of bolt 224 has threads formed therein to threadedly engage the end of bolt 224. Bolt 224 is not tightened to a point that would restrict relative movement between strut 218 and yoke 222. Accordingly, bolt 224 forms a pivotal connection between the end of strut 218 and lower frame member 134.

Floor panel 44 rests upon, and is preferably screwed to, the upper surfaces of floor support struts 216, 218, and 220, so that they alone transfer the load on lift car floor 44 to the first and second sides 114 and 116 of the lift car structural frame. In this manner, any rotational torque induced in floor panel 44, and into floor support struts 216, 218 and 220, under loading by the occupant of the wheel chair, is isolated from first and second sides 114 and 116 of the lift car structural frame. Therefore, first and second sides 114 and 116 of the lift car structural frame retain their generally vertical orientation. Screws used to secure floor panel 44 to floor support struts 216, 218, and 220 should be easy to remove, since floor panel 44 needs to be removed before collapsing lift car 42 to a narrower width. Likewise, the bolts used to "pin" at least one end of floor support struts 216, 218, and 220 are preferably easy to remove, again for allowing the width of the lift car structural frame to be collapsed after floor panel 44 is removed for transport through narrow passageways.

In order to ensure the integrity of the lift car structural frame, and to reliably couple together first and second sides 114 and 116 of the structural frame, a series of four frame struts, which includes those designated 226, 228, 230 and 231 in the drawings, are also preferably provided, as shown in FIGS. 6A-6C and FIG. 7. Each such frame strut has a first end fixedly connected, as by welding, to a lower horizontal frame member of first side 114 of the lift car structural frame, and has a second opposing end fixedly connected, as by welding, to a lower horizontal frame member of second side 116 of the lift car structural frame. For example, frame struts 226 and 228 have their first ends welded to horizontal frame member 134, while frame strut 231 has its first end welded to horizontal frame member 136. Each of such frame struts is spaced sufficiently below lift car floor panel 44 to avoid contact therewith, even when the lift car is under load. Accordingly, the load applied to the lift car floor is borne solely by floor support struts 216, 218, and 220.

In order to allow the lift car width to be collapsed for transport, each of frame struts 226, 228, 230 and 231 is preferably provided as a pair of sliding strut members that slidingly engage each other. For example, in FIG. 7, frame strut 226 is actually formed by sliding members 232 and 234. At least one releasable fastener, e.g., a clamping screw, is provided where the two sliding members mate for allowing the length of each such frame strut assembly to be adjusted. This permits the spacing between first and second sides 114 and 116 of the lift car structural frame to be varied between a deployed condition for use, and a collapsed position for transport. In the preferred embodiment, each such pair of sliding strut members telescopically nest with each other.

Figure 13:
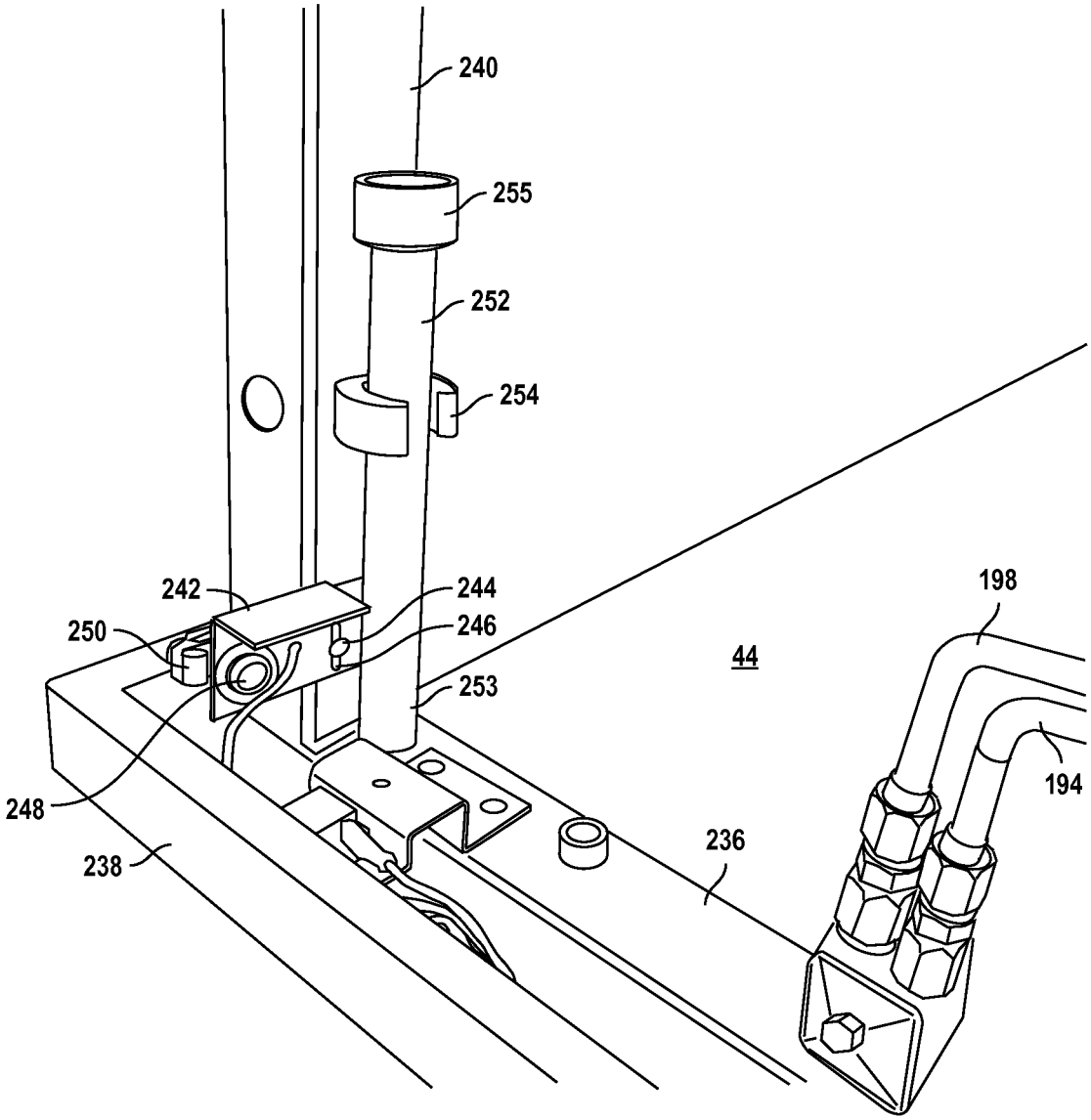
FIG. 13 is a partial perspective view (with decorative skins omitted) of a light source and optical sensor used to control the maximum lift height, as well as a height adjustment tool placed in its stowed position.

It will be recalled that one of the objectives of the present invention is to be able to quickly and easily adjust the maximum height to which the lift is elevated each time the lift is moved to a different platform or stage. A related objective is to be able to raise the floor of the lift car repeatedly, and reliably, to the pre-set maximum height. Referring now to FIGS. 13, 14, 15A, and 15B, an improved optical height detection and adjustment system is disclosed. Within FIG. 13, a lower portion of second side 116 of the lift car structural frame is shown. To place FIG. 13 in context, lower horizontal frame members 236 and 238 extend along the lower portion of second side 116 proximate to vertical frame member 240; vertical frame member 240 is visible in FIG. 8 and lies adjacent to rear exit gate 54 when such gate is closed. An L-shaped mounting bracket 242 is secured by one or more screws 244 to vertical frame member 240. Screw 244 is inserted within a vertically-extending slot 246 formed in mounting bracket 242, which allows for adjustment of the height of mounting bracket 242 relative to horizontal frame member 236. A light source 248 is secured to mounting bracket 242 for emitting a focused beam of light generally parallel to horizontal frame members 236 and 238, and toward second guide member 112. An optical sensor 250 is also secured to mounting bracket 242. Optical sensor 250 is preferably of the type commercially available from Banner Engineering Corp. of Minneapolis, Minn. under part number QS18VP6LV, which includes both optical sensor 250 and light source 248. Optical sensor 250 extends past the edge of mounting bracket 242 but is shielded from the beam emitted directly by light source 248. Optical sensor 250 is also focused toward second guide member 112, and is responsive to light originally sourced from light source 248, after being reflected back toward optical sensor 250 from the direction of second guide member 112. Also visible within FIG. 13 is a reflector placement tool 252 stowed within holder 254. The purpose of placement tool 252 will become more apparent as the present description proceeds.

Figure 14:
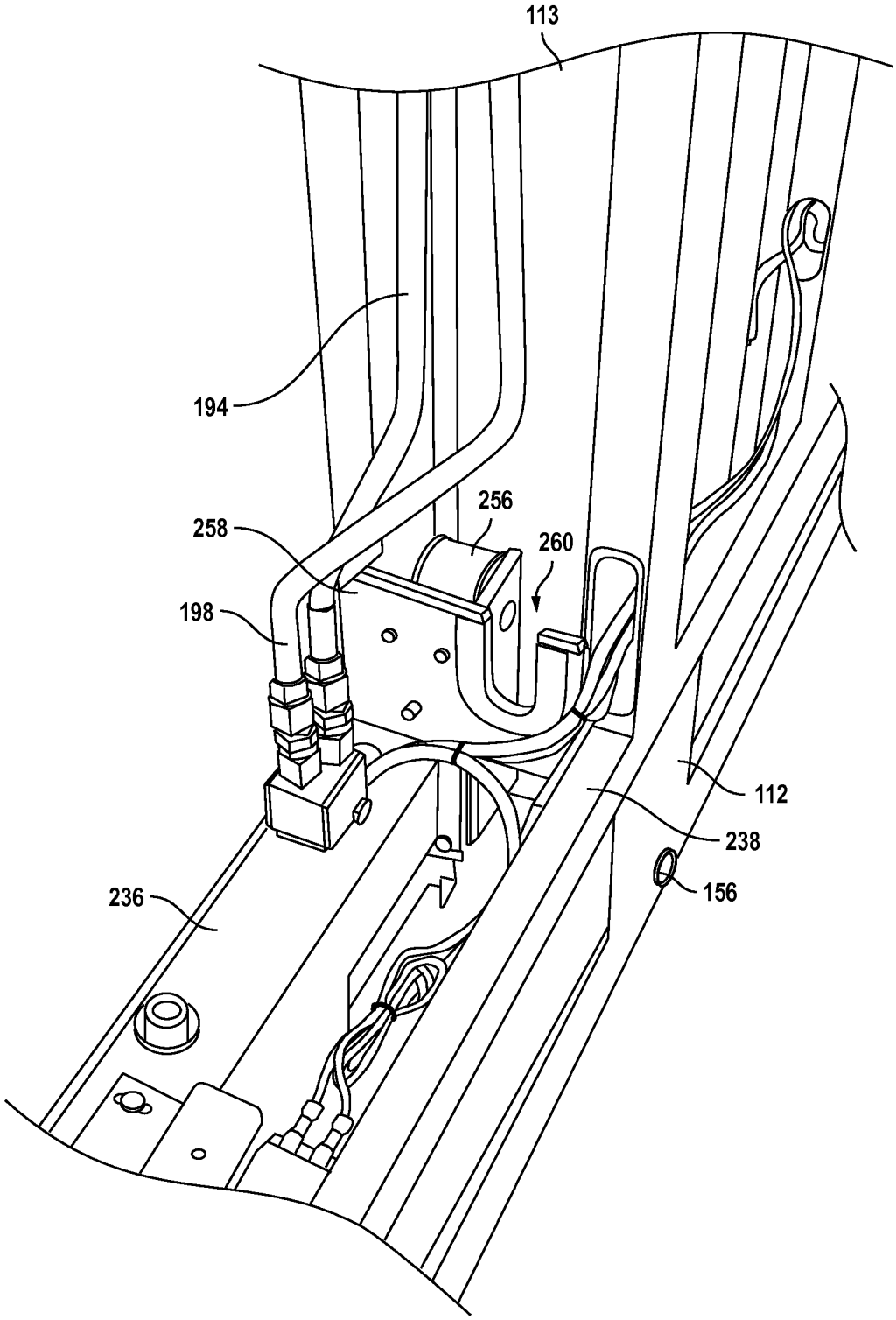
FIG. 14 is a partial perspective view of one side of the lift car (with decorative skins omitted), and illustrating a U-shaped bracket serving as a reference guide when setting the maximum height of the lift car.

FIG. 14 is also a view of the lower portion of second side 116 of the lift car structural frame, and shows in particular vertical guide member 112 received within second side 116. Within FIG. 14, roller 256 corresponds to one of the rollers used to rollingly engage vertical face 113 of guide member 112. It will be noted that a bracket 258 is secured to the lower portion of second side 116, closely proximate in which guide member 112 is received thereby. Bracket 258 has a U-shaped reference port, or saddle, 260 formed therein. Referring back to FIG. 13 briefly, the light beam emitted by light source 248 is directed to pass through reference port 260 for striking vertical face 113 of guide member 112. Likewise, optical sensor 250 is aligned with reference port 260 for receiving light reflected from guide member 112, through reference port 260, back toward optical sensor 250.

Figure 15A:
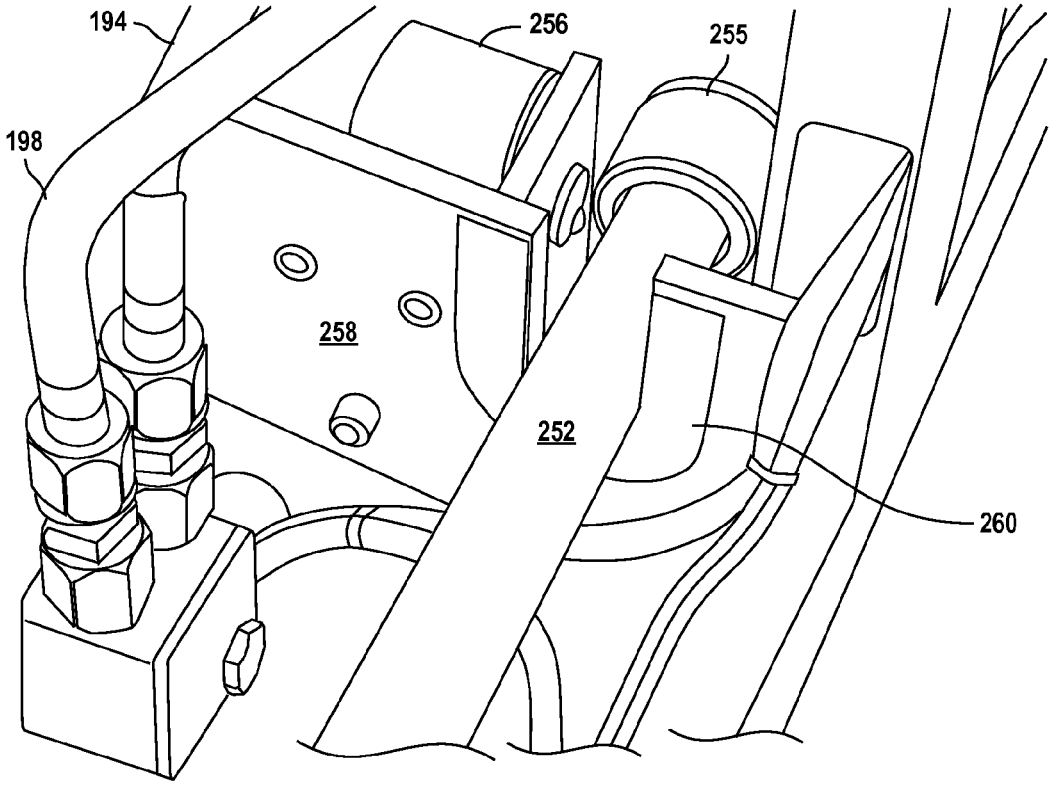
FIG. 15A is a partial perspective view similar to FIG. 14 but wherein the height adjustment tool is inserted into the U-shaped bracket to accurately place an optical reflector.
Figure 15B:
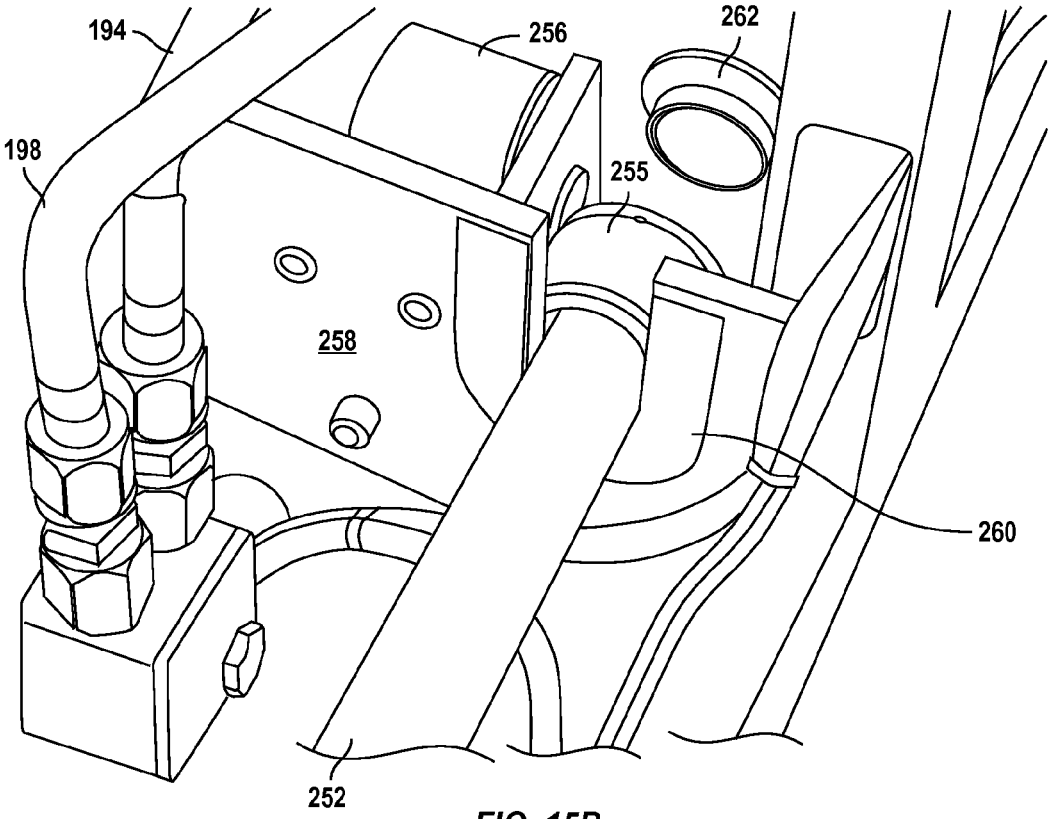
FIG. 15B is a partial perspective view similar to FIG. 15A but wherein the height adjustment tool is being withdrawn to reveal the optical reflector placed thereby.
Figure 16A:
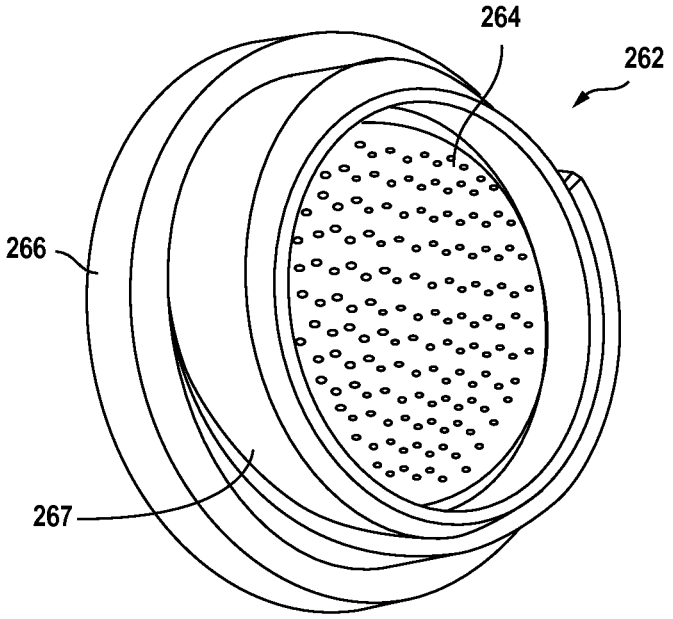
FIG. 16A is a perspective close-up front view of the optical reflector shown in FIG. 15B.
Figure 16B:
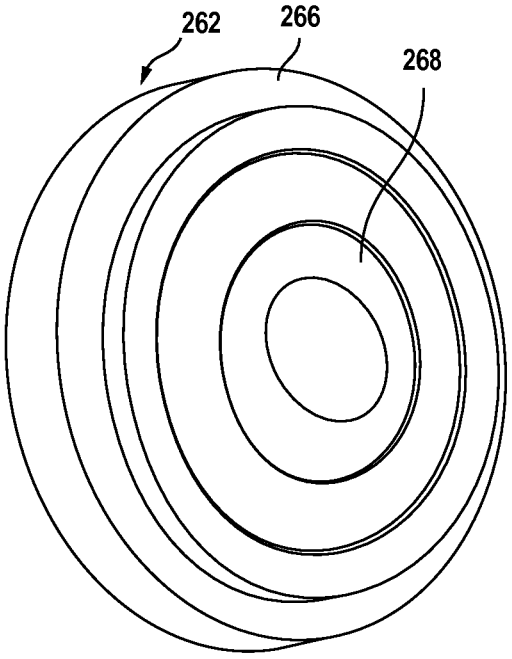
FIG. 16B is a perspective close-up rear view of the optical reflector shown in FIG. 16A.

Light source 248 and optical sensor 250 form part of a height adjust system for stopping the operation of electric motor 176 in the direction that would further elevate lift car 42. This height adjust system stops motor 176 from further raising lift car 42 when it reaches a desired, predetermined maximum height. In order to set the predetermined maximum height, a reflector 262 is used, as shown in FIGS. 15B, 16A, and 16B. As shown best in FIG. 16A, reflector 262 includes a front reflective face 264 encased in a metal housing 266. Preferably, reflector 262 includes a magnetic backing 268 (see FIG. 16B). Reflector 262 is adapted to be removably secured along vertical face 113 of guide member 112, outside the path of roller 256, and laterally aligned with reference port 260. Reflector 262 may be regarded as a "light-sending element" in the sense that it sends light originally emitted by light source 248 back toward optical sensor 250. When lift car 42 is elevated to the point at which reflector 262 becomes vertically aligned with reference port 260, reflector 262 intercepts the beam of light emitted from light source 248 and reflects it back. Light reflected by reflector 262 strikes optical sensor 250, which then generates an electrical signal used to disable motor 176 from further elevating lift car 42.

Figure 17A:
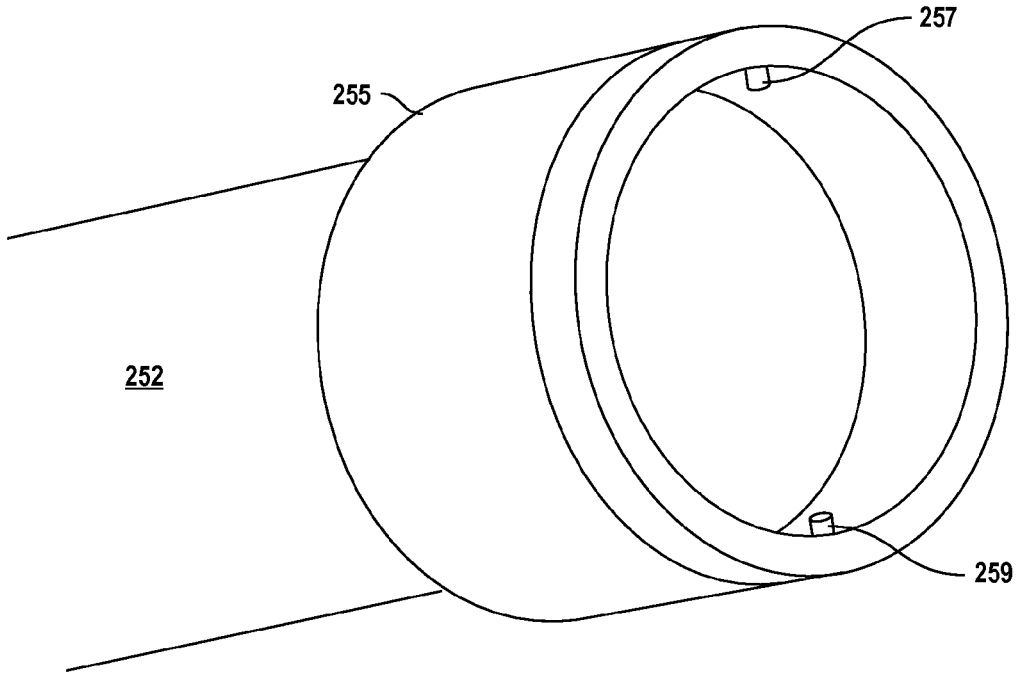
FIG. 17A is a partial perspective close-up view of the functional end of the height adjustment tool shown in FIGS. 15A and 15B, before engaging the optical reflector.
Figure 17B:
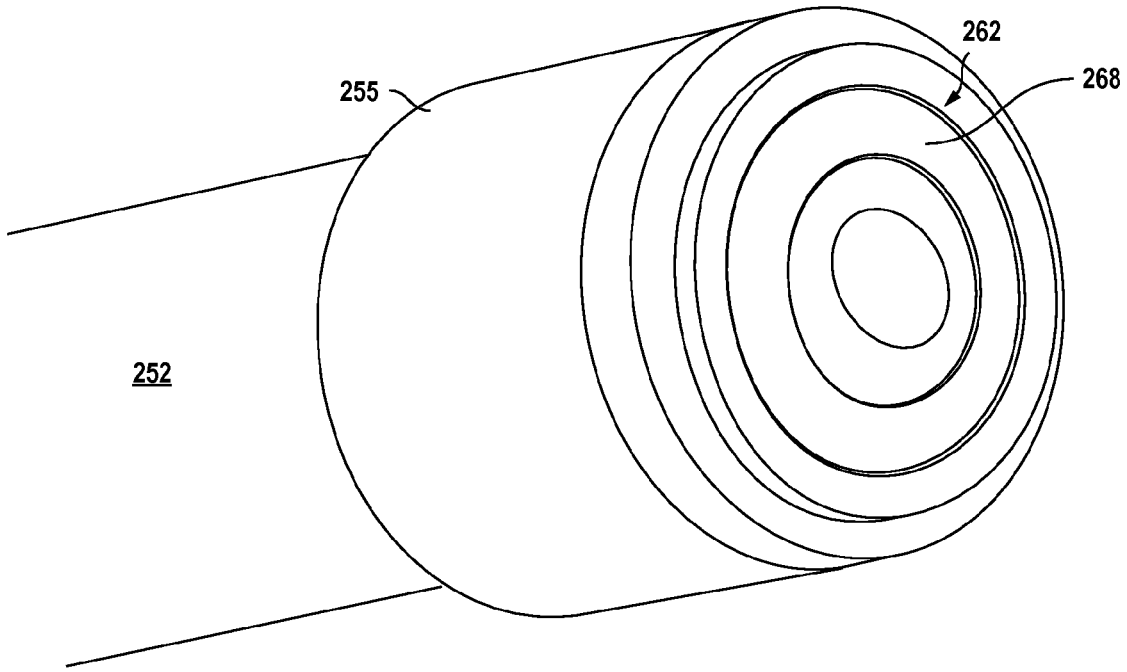
FIG. 17B is a partial perspective close-up view of the functional end of the height adjustment tool shown in FIGS. 15A and 15B, after engaging the optical reflector.

Thus, by releasably securing reflector 262 along vertical face 113 of guide member 112, using magnetic backing 268, reflector 262 can be used to quickly and easily set the desired maximum height. After positioning lift device 30 adjacent a stage or platform, a technician opens access panel 78 (see FIG. 3) to retrieve reflector placement tool 252 from its holder 254. The technician operates the lift by pressing "UP" and "DOWN" buttons until the lift car floor 44 is exactly even with upper platform 32 of the stage. As shown in FIG. 13, placement tool 252 includes a first end 253 for being held by a user, and an enlarged second end 255 for releasably engaging reflector 262. The technician then engages reflector 262 with second end 255 of placement tool 252. As shown in FIG. 16A, reflector housing 266 may include a threaded perimeter 267. Also, as shown in FIG. 17A, the enlarged second end 255 may include a pair of detent pins 257 and 259 which threadedly engage perimeter 267 when placement tool 252 is rotated relative to reflector 262, as shown in FIG. 17B. Rotation of placement tool 252 about its longitudinal axis in a first direction (e.g., clockwise) engages reflector 262 in second end 255; rotation of placement tool 252 about its longitudinal axis in the opposite direction (e.g., counter-clockwise) disengages reflector 262 from second end 255.

Once reflector 262 is engaged within second end 255 of placement tool 252, the technician lowers the central shaft of placement tool 252 within reference port 260 until it rests upon the bottom of reference port 260. The technician then advances second end 255 toward guide member 112 by sliding placement tool 252 horizontally until magnetic backing 268 of reflector 262 engages vertical face 113 of guide member 112, as shown in FIG. 15 A. The technician then rotates placement tool in the direction which allows reflector 262 to become disengaged from placement tool 252, placement tool is returned to its holder 254 for later use, and access panel 78 is closed. The procedure for removing reflector from vertical face 113 of guide member 112 simply involves the reversal of the steps just described.

Figure 19:
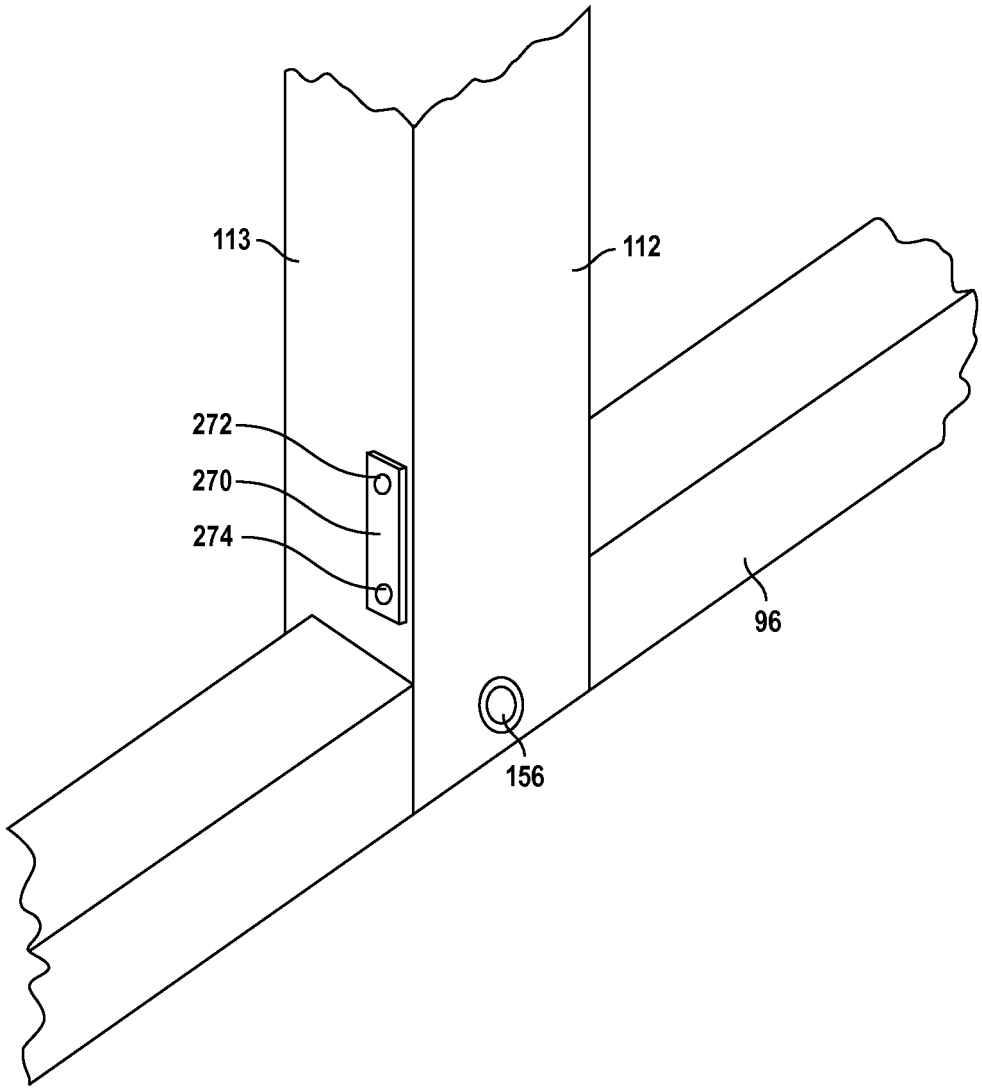
FIG. 19 is a perspective view of a permanent optical reflector used to test the functionality of the optical system before allowing the lift car to be elevated.

It will be recalled that a further object of the present invention is to provide a method of testing the functionality of the height adjust system before lift car 42 is actually elevated. FIG. 19 shows the lower end of second guide member 112, and its vertical face 113, with lift car 42 in an elevated position and out of view. A second, permanent reflector 270 is secured by screws 272 and 274 near the lower end of vertical face 113. When lift car 42 is fully-lowered, reflector 270 is aligned with reference port 260 of FIG. 14; accordingly, assuming that light source 248 and optical sensor 250 (see FIG. 13) are working properly, optical sensor 250 detects light reflected by permanent reflector 270, and signals the electronic control circuit that the height adjust system is operational. Elevation of lift car 42 is then permitted above floor level. If, on the other hand, optical sensor 250 does not signal that it has detected light from reflector 270, then the electronic control circuit does not permit lift car 42 to be elevated.

Figure 10:
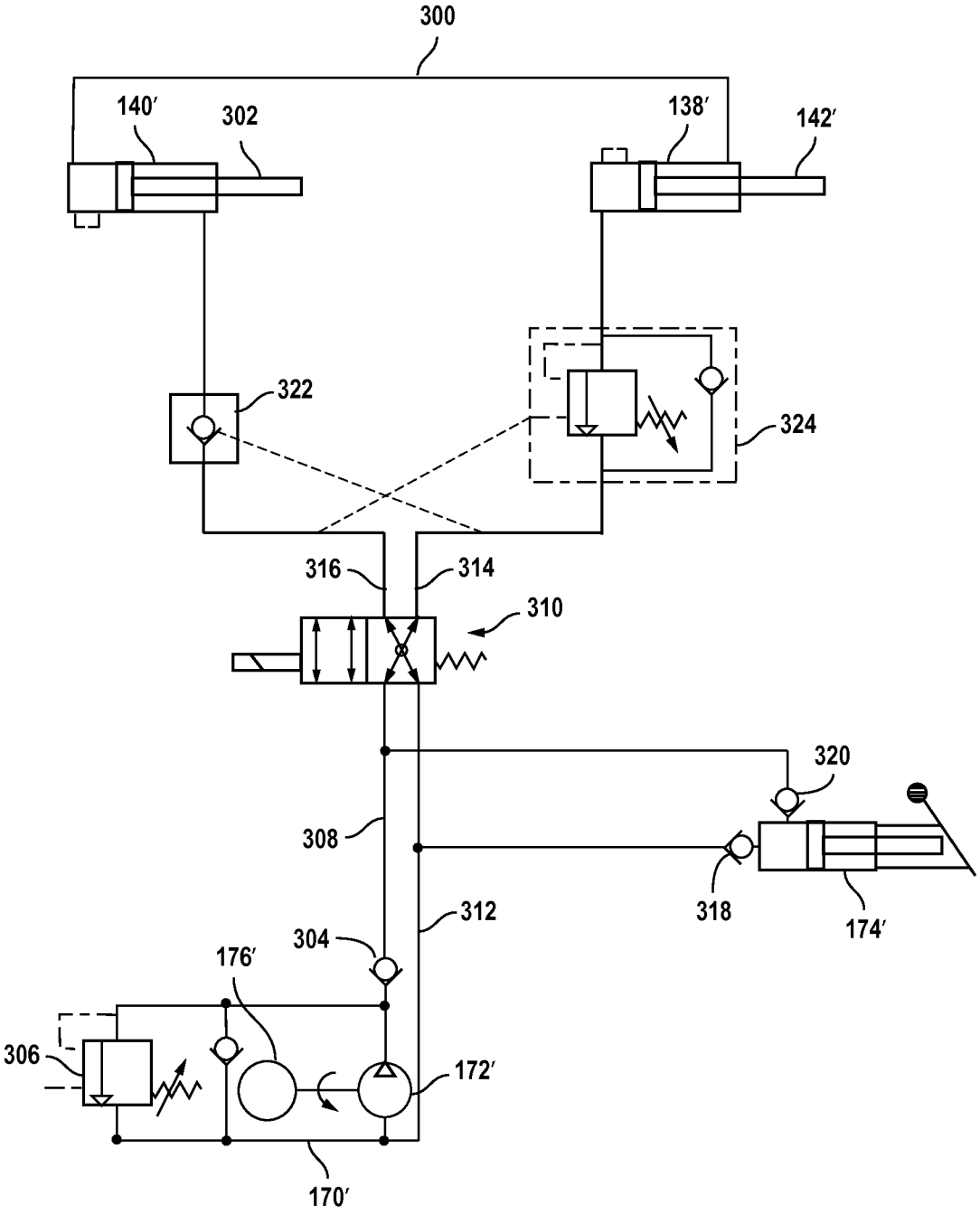
FIG. 10 is a schematic drawing illustrating the hydraulic components used to elevate and lower the lift car.

The operation of lift device 30 will now be described with reference to the schematic of FIG. 10. A pair of hydraulic lifting cylinders 138' and 140' (corresponding to cylinders 138 and 140 in FIG. 9) raise and lower lift car 42 (not shown). Preferably, hydraulic cylinders 138/138' and 140/140' are of the type generally available from Ram Industries Inc., a Canadian company based in Yorkton, Saskatchewan, Canada. Cylinder 138' is preferably of the type available from Ram Industries Inc. as Model No. R4506994 (3000 psi operating pressure, 2.5" bore, 41.5" stroke, 1.125" piston rod diameter), while cylinder 140' is preferably a Model No. R4506995 (3000 psi operating pressure, 2.75" bore, 40.5" stroke, 1.125" piston rod diameter). Cylinders 138' and 140' each include an expansion chamber and a retraction chamber. The expansion chamber of cylinder 138' is coupled by tube 300 to the retraction chamber of cylinder 140'. When lift car 42 is being raised, pressurized hydraulic fluid is forced into the expansion chamber of cylinder 138', extending piston rod 142', compressing fluid in the retraction chamber of cylinder 138', and forcing the compressed fluid into the expansion chamber of cylinder 140' for extending piston rod 302. Alternatively, when the lift is being lowered, pressurized hydraulic fluid is forced into the retraction chamber of cylinder 140', retracting piston rod 302, compressing fluid in the expansion chamber of cylinder 140', and forcing the compressed fluid through tube 300 into the retraction chamber of cylinder 138' for retracting piston rod 142'.

Still referring to FIG. 7, electric motor 176' rotates in a fixed direction to rotate the input drive shaft of hydraulic fluid pump 172'. Pump 172' draws hydraulic fluid from low pressure side 170', and pumps hydraulic fluid out under pressure through check valve 304. Relief valve 306, which may be integral with pump 172', can be adjusted to permit a selected amount of pressurized hydraulic fluid to be directed back to low pressure side 170'.

Still referring to FIG. 7, hydraulic fluid pressurized by pump 172' is supplied via high pressure conduit 308 to the high pressure inlet of a solenoid valve 310. Solenoid valve 310 also includes a low pressure outlet coupled to return conduit for coupling to low pressure side 170'. Solenoid valve 310 is normally biased (by a spring) to a position for extending piston rods 142' and 302'. In this case, solenoid valve 310 assumes the default crossed-over position shown in FIG. 7, wherein high pressure inlet line 308 is coupled to line 314, and low pressure outlet 312 is coupled to line 316. Preferably, solenoid valve 310 is a 24 VDC solenoid valve with manual override commercially available from the Deltrol Fluid Products Division of Deltrol Corporation of Bellwood, Ill. of Glendale Heights, Ill., under Part Number DSV2-4C0.

In the event of a power failure, motor 176' that powers hydraulic pump/manifold unit 172' will no longer operate. For this reason, hydraulic hand pump 174' is provided in an emergency to raise and lower the lift car without electrical power. Still referring to FIG. 7, hand-operated fluid pump 174' includes a fluid inlet coupled through a check valve 318 to low pressure return line 312 for receiving un-pressurized hydraulic fluid. Pump 174' also includes a high-pressure outlet port for supplying pressurized hydraulic fluid through check valve 320 to high pressure line 308. A lever can be reciprocated by an operator to raise or lower the lift using such hand-operated pump 174' if motor 176' is lacking electrical power. Pump 174' may similar to the type available from the Deltrol Fluid Products Division of Deltrol Corporation of Bellwood, Ill. of Glendale Heights, Ill., under Part Number DHP-100.

As shown in FIG. 7, pilot-operated check valve 322 couples line 316 to the retraction chamber of hydraulic cylinder 140'. Valve 322 is preferably of the type commercially available from HydraForce, Inc. of Lincolnshire, Ill., under Part Number PC08-30. Line 314 is coupled by an over-center, counter-balance, spring-biased valve 324 to the expansion chamber of cylinder 138'. Valve 324 is preferably similar to the type commercially available from Bucher Hydraulics—Illinois, Inc. (formerly, "Command Controls Corp.") of Elgin, Ill., under Part Number CBPA-08. Valve 324 is adjustable to help ensure that cylinders 138' and 140' expand and retract at the same rate.

Figure 11:
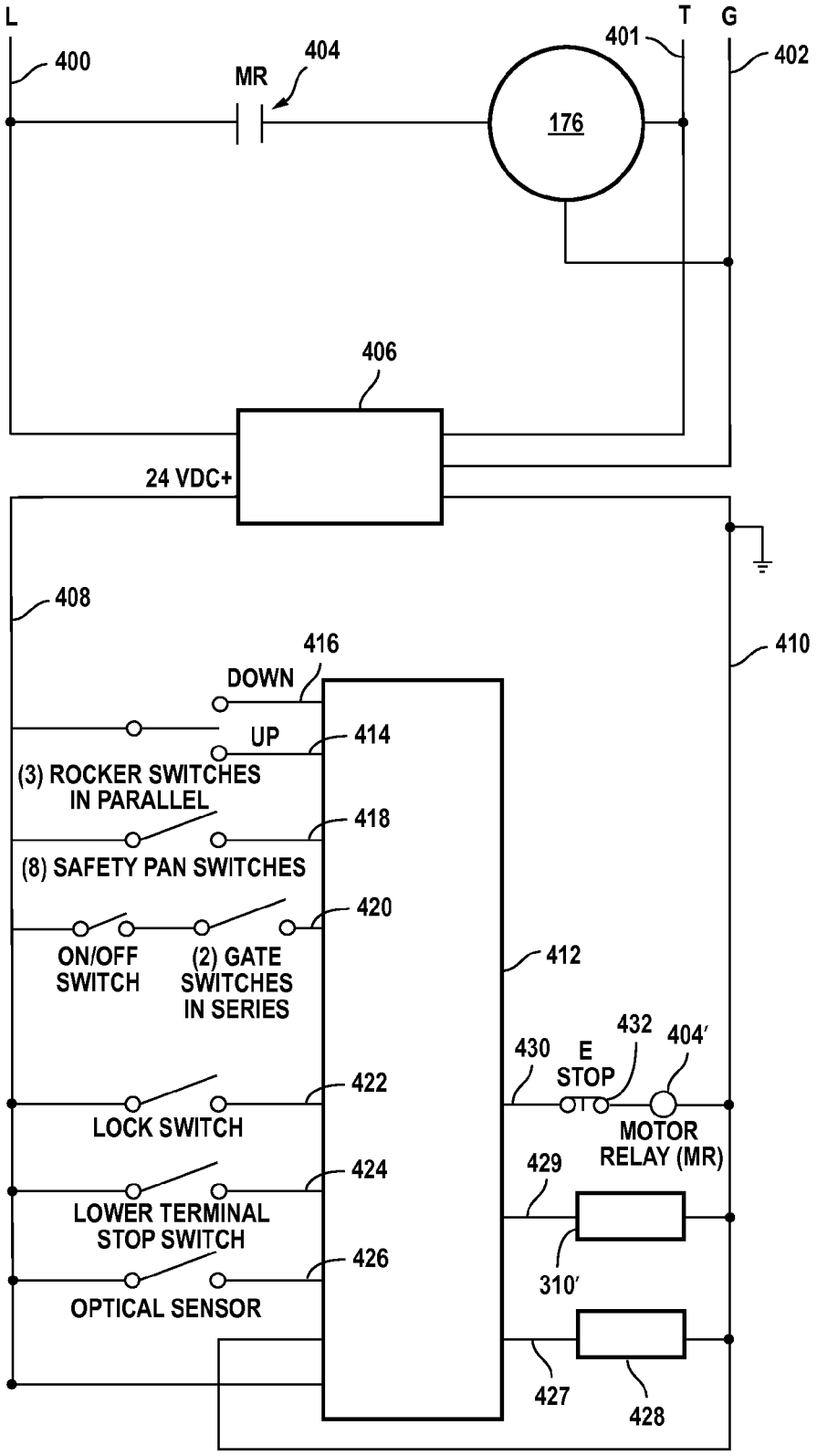
FIG. 11 is an electrical schematic showing the principal electrical components of the wheelchair lift device for controlling the elevation and lowering of the lift car.

FIG. 11 provides an electrical schematic illustrating the circuitry used to control the operation of lift device 30. Power input lines 400 and 401 supply 120 VAC electrical power. Line 402 represents a system ground. Referring briefly to FIG. 6B, electrical power is conveyed from the floor up to lift car 42 by guiding an electrical cable 85 from GFCI device 86 upwardly through guide member 106 to its upper end 110. As cable 85 exits from upper end 110 of guide member 106, cable 85 bends downwardly and enters into a cable chain 87 of the type available from Igus Inc. of East Providence, R.I. Cable chain 87 forms a movable loop 89 at its lowermost point and then passes upwardly into first side 114 of the lift car structural frame. The upper end of cable chain 87 is secured to a mounting bracket for electrical control panel, and the electrical cable secured within cable chain 87 exits from cable chain 87 just before reaching the upper end of cable chain 87. As lift car 42 moves up and down, the height of loop 89 also moves up and down, but the electrical cable always lies safely within first side 114.

Electric motor 176, used to operate the hydraulic pump, is coupled across lines 400 and 401 under the control of a motor relay (MR) 404. Motor relay 404 is preferably of the type available from Magnecraft, a division of Schneider Electric, of Des Plaines, Ill., under part number 781XAXM4L-24D. Power lines 400 and 401, and system ground 402, are also coupled to an AC to DC power converter 406. Output lines 408 and 410 from converter 406 provide a regulated source of 24-volt DC power and ground, respectively.

The heart of the electronic control circuitry is a so-called "smart relay" logic controller 412. Smart relay 412 may be of the type commercially available from IDEC Corporation of Sunnyvale, Calif., under model number FL1EB12RCE. Two of the input signals 414 and 416 supplied to smart relay 412 are the "UP" switches and "DOWN" switches provided near the front entry gate (switch 62), near the rear exit gate (switch 74), and inside lift car 42 (switch 65 in FIG. 5). Each of such switches is provided in the form of a "rocker" switch wherein movement in the "UP" direction is requested by rocking the switch in one direction, and movement in the "DOWN" direction is requested by rocking the switch in the opposite direction. The three "UP" switches are coupled in parallel to input 414 to signal that the lift car should be raised, and the three "DOWN" switches are coupled in parallel to input 416 to signal that the lift car should be lowered.

Input 418 of smart relay 412 is coupled to a series of eight safety pan switches, all coupled in series with each other. These safety pan switches are distributed about the periphery of the lower portion of lift car 42 adjacent a "safety pan" that is suspended from the bottom of lift car 42. In the event that the safety pan contacts a foreign object before lift car 42 is fully-lowered to the ground, the safety pan engages, and actuates, one or more of such safety pan switches, signaling that the pump motor should immediately stop to avoid injury or damage. These safety pan switches are normally closed, and the actuation (i.e., opening) of any safety pan switch, among the series-connected group of such switches, triggers the electronic control circuit to stop the lift.

Input 420 of smart relay 412 is coupled to a pair of gate switches coupled in series with each other, and is further coupled in series with a keyed master on/off switch. The gate switches are provided at the front entry gate 40 and rear exit gate 54. Each such switch provides a conductive path only if its respective gate is closed. Smart relay 412 will allow operation of the pump motor only if the master on/off switch is set to "on", and both gate switches are closed (i.e., conductive).

Input 422 of smart relay 412 is coupled to a lock switch; this lock switch is used to unlock the front entry gate 40. If the lock switch is opened, indicating that the front entry gate is unlocked, then smart relay 412 will not allow lift car 42 to move.

Input 424 of smart relay 412 is coupled to a lower terminal stop switch. This lower terminal stop switch is located in first side 114 of the lift car structural frame near the upper end of cylinder 138 and is contacted by the upper end of guide member 106 about one inch before lift car 42 reaches the ground. In this manner, smart relay 412 can disregard the subsequent triggering of the safety pan switches which follows as the safety pan makes contact with the ground.

Input 426 of smart relay 412 is coupled to optical sensor 250 of the height adjust system. Input 426 receives the failsafe signal when the lift is fully-lowered to confirm that the height adjust system is functional before allowing motor 176 to elevate lift car 42. Input 426 also receives the maximum height signal generated by optical sensor 250 when lift car 42 has been elevated to the pre-set maximum height. In this regard, smart relay 412 can distinguish between the failsafe signal (when the lift car is fully lowered) and the maximum height signal (when the lift is almost fully-raised) by noting whether or not the lower terminal stop switch is open or closed. If the lower terminal stop switch is closed, then the lift is no more than perhaps one inch above the ground, and the signal generated by optical sensor 250 is a failsafe signal. On the other hand, if the lower terminal stop switch is open, then the lift has already elevated more than one inch, and the signal generated by optical sensor 250 must be indicating that the maximum desired height has been reached.

Smart relay 412 generates three output signals in response to the aforementioned input signals. Output signal 427 is applied to a lock solenoid 428 which, as described above, must be energized before allowing front entry gate 40 to be opened. Output signal 429 is applied to solenoid valve 310 (see FIG. 10) to control the direction (up or down) in which lift car 42 is moved when the hydraulic pump motor is operated. Finally, output signal 430 is applied, through normally closed "E-Stop" switch 432 to the controlling input terminal of motor relay 404; it will be recalled that the output terminals of motor relay 404 are used to control the application of 120 VAC power across pump motor 176. If the occupant of lift car 42 depresses Emergency Stop switch 432, motor relay 404 immediately disconnects 120 VAC power from pump motor 176.

Those skilled in the art will now appreciate that an improved wheel chair lift has been described for safely and reliably lifting wheelchair-bound users up to the height of stages, platforms, risers and the like. The disclosed lift device has a low profile and avoids any significant interference with an audience's view of events taking place. The disclosed lift uses direct-drive hydraulic cylinders to minimize the size, weight and cost of the lift device without sacrificing stability. The disclosed lift device essentially limits exposed moving parts to the lift car itself, without requiring other exposed moving components around and/or below the lift device which might otherwise require a protective skirt. The disclosed lift device is relatively inexpensive, easy to construct and use, simple to maintain, and easy to collapse and/or transport.

Moreover, the disclosed lift device allows the lift car floor to be lowered to the ground to avoid the need for an entry ramp, while avoiding deformation of the lift car side walls away from their usual vertical orientation. The height adjust system described above allows a user to quickly and easily adjust the maximum height to which the lift car is raised, thereby allowing the lift device to be repeatedly raised to the height of the platform with which the lift device is currently being used. In addition, the above-described failsafe feature of the height adjust system verifies that the control system used to halt further elevation of the lift car after reaching the selected maximum height, is operational before permitting the lift car to be elevated significantly.

While the present invention has been described with respect to a preferred embodiment thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A wheelchair lift comprising in combination:

a. a base for resting upon a floor when the wheelchair lift is in use, the base including first and second opposing sides;

b. a first guide member extending generally vertically and having upper and lower opposing ends, the lower end of the first guide member being fixedly coupled to the first side of the base, the first guide member including a hollow internal channel;

c. a second guide member extending generally vertically and having upper and lower opposing ends, the lower end of the first guide member being fixedly coupled to the second side of the base, the second guide member including a hollow internal channel;

d. a lift car movable in a vertical direction for supporting an occupant of a wheelchair, the lift car including:

i) a structural frame including first and second opposing sides, each of the first and second opposing sides of the structural frame extending generally vertically from a lower portion to an upper portion;

ii) a floor panel supported between the lower portions of the first and second opposing sides of the structural frame;

e. a first hydraulic cylinder having a first piston rod extendable therefrom, the first hydraulic cylinder including a closed end and an opposing open end, the first piston rod being extendable from the open end of the first hydraulic cylinder, the first piston rod having a free end extendable away from the first hydraulic cylinder, and having a captive end remaining within the first hydraulic cylinder;

f. a second hydraulic cylinder having a second piston rod extendable therefrom, the second hydraulic cylinder including a closed end and an opposing open end, the second piston rod being extendable from the open end of the second hydraulic cylinder, the second piston rod having a free end extendable away from the second hydraulic cylinder, and having a captive end remaining within the second hydraulic cylinder;

g. the first hydraulic cylinder being attached to the first side of the structural frame for vertical movement with the lift car, the open end of the first hydraulic cylinder extending within the hollow internal channel of the first guide member for movement therethrough as the lift moves up and down;

h. the free end of the first piston rod being fixedly coupled to the first side of the base;

i. the second hydraulic cylinder being attached to the second side of the structural frame for vertical movement with the lift car, the open end of the second hydraulic cylinder extending within the hollow internal channel of the second guide member for movement therethrough as the lift moves up and down; and j. the free end of the second piston rod being fixedly coupled to the second side of the base;

whereby the first and second piston rods are extended and retracted from the first and second hydraulic cylinders to raise and lower the lift car, respectively.

2. The wheelchair lift recited by claim 1 wherein:

a. the upper end of the first guide member is received within the first side of the structural frame; and b. the upper end of the second guide member is received within the second side of the structural frame.

3. The wheelchair lift recited by claim 1 wherein:

a. the closed end of the first hydraulic cylinder is attached to the upper portion of the first side of the structural frame; and b. the closed end of the second hydraulic cylinder is attached to the upper portion of the second side of the structural frame.

4. The wheelchair lift recited by claim 1 wherein the first and second guide members each include first and second opposing vertical faces, the wheelchair lift further including:

a. first and second rollers pivotally coupled to the lower portion of the first side of the structural frame, the first and second rollers rotatably engaging the first and second vertical faces, respectively, of the first guide member as the lift car moves up and down; and b. third and fourth rollers pivotally coupled to the lower portion of the second side of the structural frame, the third and fourth rollers rotatably engaging the first and second vertical faces, respectively, of the second guide member as the lift car moves up and down.

5. The wheelchair lift recited by claim 1 wherein:

a. the first piston rod includes an extended portion external from the first hydraulic cylinder, the extended portion of the first piston rod lying substantially within the hollow internal channel of the first guide member; and b. the second piston rod includes an extended portion external from the second hydraulic cylinder, the extended portion of the second piston rod lying substantially within the hollow internal channel of the second guide member.

6. The wheelchair lift recited by claim 1 wherein each of the first and second guide members is a tube having a generally rectangular cross-section surrounding a hollow internal channel.

7. The wheelchair lift recited by claim 6 wherein each such tube has a generally square cross-section.

8. The wheelchair lift recited by claim 1 wherein each of the first and second guide members is formed of C-channel stock having a generally rectangular internal channel.

9. The wheelchair lift recited by claim 1 further including:

a. a reservoir of hydraulic fluid, the reservoir being supported by the structural frame of the lift car for movement up and down therewith;

b. a hydraulic pump coupled to the reservoir for pressuring hydraulic fluid, the hydraulic pump being supported by the structural frame of the lift car for movement up and down therewith;

c. a motor coupled to the hydraulic pump for rotating the hydraulic pump, the motor being supported by the structural frame of the lift car for movement up and down therewith; and d. hydraulic tubing coupled between the hydraulic pump and the first and second hydraulic cylinders for conveying hydraulic fluid used to extend and retract the first and second piston rods, the hydraulic tubing being supported by the structural frame of the lift car and by the first and second hydraulic cylinders for movement up and down with the lift car.

10. The wheelchair lift recited by claim 9 wherein the hydraulic tubing includes:

a. a first portion of tubing supported within the first side of the structural frame and coupled to the first hydraulic cylinder;

b. a second portion of tubing supported within the second side of the structural frame and coupled to the second hydraulic cylinder; and c. a third portion of tubing extending below the floor panel.

11. The wheelchair lift recited by claim 10 wherein at least the first and second portions of tubing are generally rigid tubing.

12. The wheelchair lift recited by claim 10 wherein the third portion of tubing extending below the floor panel includes at least one flexible hose to allow for variation in spacing between the first and second sides of the structural frame of the lift car.

13. The wheelchair lift recited by claim 1 wherein:

a. the first and second opposing sides of the base each includes an elongated, generally horizontally-extending base side member for resting upon a floor when the wheelchair lift is in use;

b. the lower portions of the first and second opposing sides of the structural frame of the lift car are substantially at ground level when the lift car is fully lowered; and c. the floor panel of the lift car is substantially at ground level when the lift car is fully lowered.

14. The wheelchair lift recited by claim 1 wherein the first and second hydraulic cylinders bear substantially the entire weight of the lift car when the lift car is raised above the floor.

* * * * *